US005944762A

United States Patent [19]

Bessacini et al.

[11] Patent Number: 5,944,762

[45] **Date of Patent: *Aug. 31, 1999**

[54] HIERARCHICAL TARGET INTERCEPT FUZZY CONTROLLER WITH FORBIDDEN ZONE

[75] Inventors: Anthony F. Bessacini, Narragansett; Robert F. Pinkos, Saunderstown, both of R.I.

[73] Assignee: The United States of America as represented by the Secretary of the Navy, Washington, D.C.

[ * ] Notice: This patent is subject to a terminal disclaimer.

[21] Appl. No.: 08/627,764

[22] Filed: Apr. 1, 1996

[51] Int. Cl.[6] ..... G06F 165/00

[52] U.S. Cl. ..... 701/27; 701/1; 244/3.13; 244/3.15

[58] Field of Search ..... 701/1, 23, 27, 701/302; 395/3, 900, 905; 318/589; 244/3.1, 3.11, 3.13, 3.14, 3.15, 3.19

[56] References Cited

U.S. PATENT DOCUMENTS

| | | | |
|---|---|---|---|
| 4,732,349 | 3/1988 | Maurer | 244/3.13 |
| 5,080,300 | 1/1992 | Stubbs et al. | 244/3.14 |
| 5,101,351 | 3/1992 | Hattori | 395/905 |
| 5,118,050 | 6/1992 | Arnold et al. | 244/3.19 |
| 5,319,556 | 6/1994 | Bessacini | 701/27 |
| 5,429,322 | 7/1995 | Waymeyer | 244/3.15 |
| 5,436,832 | 7/1995 | Bessacini et al. | 701/27 |
| 5,671,138 | 9/1997 | Bessacini et al. | 701/1 |
| 5,671,139 | 9/1997 | Bessacini et al. | 701/1 |
| 5,671,140 | 9/1997 | Bessacini et al. | 701/1 |

*Primary Examiner*—Gary Chin

*Attorney, Agent, or Firm*—Michael J. McGowan; Prithvi C. Lall; Michael F. Oglo

[57] ABSTRACT

A target intercept guidance system for directing a steerable object, such as a torpedo with a guidance point. The guidance system is located at a launching vehicle and senses the bearings from the launching vehicle to a target and to the steerable object as it moves toward the target. Various error signals are then generated and classified into sensed linguistic variables using membership functions of corresponding sensed variable membership function sets based upon primary and secondary goals to become fuzzy inputs that produce fuzzy control output membership functions from a control output membership function set based upon logical manipulation of the fuzzy inputs. The control system performs this classification and selection according to sometimes competing goals of excluding the torpedo from a particular operating zone while guiding the torpedo in response to variations in a target bearing relative to the guidance point. The selected fuzzy control output membership functions are converted into an output having an appropriate form for control, subject to optional conditioning to prevent unwanted effects and assure good behavior for different tactical parameters.

34 Claims, 17 Drawing Sheets

| $\Delta e_s$ \ $e_s$ | N | Z | P |
|---|---|---|---|
| N | PS | PS | – |
| Z | PM | ZE | – |
| P | PL | ZE | – |

$B_v - B_c > 0$

FIG. 7A

| $\Delta e_s$ \ $e_s$ | N | Z | P |
|---|---|---|---|
| N | NS | NS | – |
| Z | NM | ZE | – |
| P | NL | ZE | – |

$B_v - B_c < 0$

FIG. 7B

| $e_{gp}$ \ $\Delta e_{gp}$ | NL | NM | NS | ZE | PS | PM | PL |
|---|---|---|---|---|---|---|---|
| N | PL | PM | PS | ZE | NS | NM | NL |
| ZE | PL | PM | PS | ZE | NS | NM | NL |
| P | NL | NM | NS | ZE | PS | PM | PL |

FIG. 7C

HIERARCHICAL TARGET INTERCEPT FUZZY CONTROLLER WITH FORBIDDEN ZONE

STATEMENT OF GOVERNMENT INTEREST

The invention described herein may be manufactured and used by or for the Government of the United States of America for governmental purposes without the payment of any royalties thereon or therefor.

CROSS REFERENCE TO RELATED APPLICATIONS

Reference is made to co-pending U.S. patent application Ser. No. 08/498,810 filed Jul. 6, 1995 by Anthony F. Bessacini and Robert F. Pinkos for a Fuzzy Controller for Acoustic Vehicle Target Intercept Guidance.

Reference is also made to co-pending U.S. patent application Ser. No. 08/498,811 filed Jul. 6, 1995 by Anthony F. Bessacini and Robert F. Pinkos for an Hierarchical Fuzzy Controller for Beam Rider Guidance.

BACKGROUND OF THE INVENTION (1) Field of the Invention

This invention generally relates to a control system located at a first, or reference, site for guiding a steerable object from that site toward a second, or target, site. More specifically this invention relates to such a control system that is operable even when both the control system at the first site and the target at the second site undergo independent motion.

(2) Description of the Prior Art

Real time control systems based upon sensory inputs find application in air-, land- and underwater-based vehicles. For example, with respect to underwater-based applications U.S. Pat. No. 4,323,025 to Fisher et al. (1982) describes a homing torpedo with an on-board, or autonomous, steering control system that operates in a target search phase or a target acquisition phase. In the target search phase, the control system directs the torpedo along a controlled helical search path. When the torpedo acquires a target, the control system transfers to a target pursuit phase. The control system transfers back to the target search phase whenever target acquisition is lost. It is a characteristic of control system of this type, however, that control from the submarine as a launching vehicle is lost immediately upon launch.

U.S. Pat. No. 5,229,541 to Will et al. (1993) discloses a variant of the foregoing on-board, or autonomous, control system in the form of a safety system that deters a homing missile from attacking its launching vehicle. In this embodiment, a tracking circuit on the launching vehicle tracks a torpedo after launch by receiving signals from a transponder on the torpedo. If the control system on the launching vehicle determines that the torpedo has reentered a protective zone on a course homing on the launching vehicle, the control system generates a coded command that it transmits to the torpedo control system acoustically. The torpedo control system responds by altering its course and resuming a search for a target in a sector other than that in which it was acquiring a launching vehicle. In addition upon determining that the weapon is within an activation zone, the control system on the launching vehicle can produce a magnetic field substantially corresponding to the neutralization zone. When sensors on the torpedo enter that field, they neutralize the weapon detonator.

Some torpedoes and other steerable objects include acoustic or other sensory homing systems. Such homing systems have an external point in front of and along the path of the steerable object called a "guidance point". This guidance point corresponds to the centroid of the acoustic beam in the case of a torpedo with an acoustic homing device. Control systems generally must accommodate torpedoes with or without guidance points. Typically, therefore, control systems use different control modes for guiding different torpedoes toward targets. In each, the control system resides on board the submarine that constitutes a first or reference site or launching vehicle. Each control system transfers commands to and receives information from the torpedo, as a steerable object, by means of a communications link, such as a wire link.

If the range, course, speed and bearing of a target are known, a "target intercept" control mode can be used. In the target intercept control mode, a control system predicts the trajectory of the target and directs the torpedo to an anticipated intercept point. A control system operating in a "target pursuit" mode directs the torpedo so that it always points toward the target. In a "beam rider" control mode the control system directs the torpedo along a bearing between the submarine and the target.

U.S. Pat. No. 5,319,556 to Bessacini (1994) discloses adaptive trajectory apparatus for selecting one of these control modes based upon information available during each update cycle for a given situation. Notwithstanding the selected control mode, once the torpedo comes within an effective range of the target, internal torpedo guidance assumes control.

Still other approaches for directing a steerable object from a launch site to a target involve complicated control systems. These systems are generally based on sets of differential equations and estimates of input parameters. Such systems operated in response to analytical controllers.

None of the control systems including those implemented in accordance with the foregoing Bessacini patent incorporate any mechanism for readily using heuristic information in establishing control, particularly information about expertise gained through past experience. Moreover, these control systems normally require an operator to determine whether to issue a particular command to a torpedo and do not automatically generate and issue guidance commands in a continuous fashion.

Our co-pending U.S. Pat. No. (application Ser. No. 08/498,811) discloses a beam rider control system for submarine launched torpedoes that utilizes a fuzzy controller at the submarine for generating the guidance commands transferred to the torpedo over the communications link. Such fuzzy controllers rely upon information from a torpedo model and a communications link to the torpedo. The torpedo model is a mathematical replica of the torpedo that provides position and status information for post launch guidance operation. The control mechanism utilizes measured contact information, particularly a bearing from the submarine to the target, and torpedo model information, particularly the bearing from the submarine to the guidance point of the torpedo, to generate a command sequence for maintaining the guidance point on a target bearing from the submarine to the target.

Such systems therefore have, as one goal, keeping the torpedo guidance point on the bearing from the launching vehicle to the target. However, the torpedo, as a source of noise, may interfere with or contaminate the signals from the target when it is on or proximate that bearing line. This interference can degrade sensed target information at the first site before the acoustic homing device in the torpedo acquires the target. Accordingly, in the system described in a co-pending application also operates with another goal of maintaining the torpedo at some distance from the bearing line from the submarine to the target. This control system, that can operate in an iterative fashion, selects one of several sets of predetermined sensed linguistic variables pertaining to first and second goal sets and the control system produces a corresponding control output linguistic variable based upon the selected goal.

This system also includes a conditioner that constrains all command information to prevent the torpedo from traveling in a direction with a searching velocity component directed back toward the submarine. This system also conditions the commands by controlling gain, but only when the control system produces a control output in response to the other goal, namely maintaining the torpedo guidance point on the bearing line. Thus if the control system is operating to remove the torpedo from proximity to the bearing line, the conditioner operates only in response to the constraint conditions. In the target intercept mode, the conditioner operates in response to both the gain adjustment and the constraint, with gain adjustment preceding the imposition of any constraint. The gain adjustment is a function of the distance from the torpedo guidance point to the target.

It has been found, however, that it is not a simple matter to transfer various aspects of hierarchical beam rider control systems to target intercept control systems. First, the target intercept and beam rider modes require different sensed variables. Second, the command information, gain adjustment and velocity constraint, if directly applied, adversely effect the resulting command and trajectory so that it becomes probable that the torpedo will not intercept the target.

SUMMARY OF THE INVENTION

Therefore it is an object of this invention to provide an improved target intercept guidance system at a first site for automatically guiding a steerable object as it moves from the first site toward a second site.

Another object of this invention is to provide a guidance system using an improved fuzzy controller that operates located at a launching vehicle in a target intercept mode for automatically guiding a steerable object toward a target wherein both the launching vehicle and target can undergo independent motion.

Still another object of this invention is to provide a guidance system using an improved fuzzy controller in a target intercept mode that operates from a launching vehicle for automatically guiding a steerable object toward a target based on competing first and second goals.

Yet another object of this invention is to provide a guidance system using an improved fuzzy controller that operates in a target intercept mode from a launching vehicle for automatically guiding a steerable object toward a target wherein both the launching vehicle and target can undergo independent motion and the fuzzy controller further limits the location of the steerable object based upon predetermined zones relative to the target bearing from the first site to the second site.

Yet still another object of this invention is to provide a guidance system using an improved fuzzy controller for maintaining a guidance point of a steerable object on a target intercept trajectory through control of the steerable object.

Still yet another object of this invention is to provide a guidance system using an improved fuzzy controller for maintaining the guidance point of a steerable object on a target intercept trajectory while offsetting the steerable object from that trajectory.

Still yet another object of this invention is to provide a guidance system with an improved fuzzy controller for use with submarine launched torpedoes that prevents the torpedo from interfering with the process of maintaining a bearing to the target.

Still yet another object of this invention is to provide a guidance system for submarine launched torpedoes that can operate automatically and can readily accommodate diverse operating circumstances.

In accordance with one aspect of this invention, an iterative method and system, generate a command signal for guiding a steerable object from a launching vehicle to a target in response to any of competing sets of multiple goal control rules based upon signals from sensing means corresponding to bearings from the launching vehicle to the steerable object and to the target and from the steerable object to the target wherein the steerable object is characterized by a center point and by a guidance point externally of the steerable object and leading the steerable object as it travels toward the target. During each iteration, the system generates first sensed variable signals in response to the signals from the sensing means indicating the location of the steerable object with respect to a zone about a line between the launching vehicle and the target. Second sensed variable signals are generated in response to the signals from the sensing means indicating whether the bearing from the guidance point of the steerable object to the target is varying with time. The system retrieves first and second sensed linguistic variables in response to the first and second sensed variable signals, respectively, and selects at least one control output linguistic variable from a predetermined set of control output linguistic variables in response to the selected first or second sensed linguistic variables from the first set when the first sensed variable signals indicate that the steerable object is proximate or inside the predetermined zone and in response to the second set when the sensed variable signals indicate that the steerable object is outside the predetermined zone. The iteration is completed when the system generates the command signal for controlling the steerable object in response to the control output linguistic variables selection and transfers that command signal to the steerable object.

BRIEF DESCRIPTION OF THE DRAWINGS

It is intended that the appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

FIGS. 7A, 7B and 7C represent rule based matrices incorporated in the multi-goal rule based unit of FIG. 6;

FIGS. 8A through 8E depict the operation of the multi-goal rule based unit in FIGS. 3 and 6 during one set of operating conditions;

FIGS. 9A through 9E depict the operation of the multi-goal rule based unit shown in FIGS. 3 and 6 in another set of operating conditions;

DESCRIPTION OF THE PREFERRED EMBODIMENT

Figure 1:
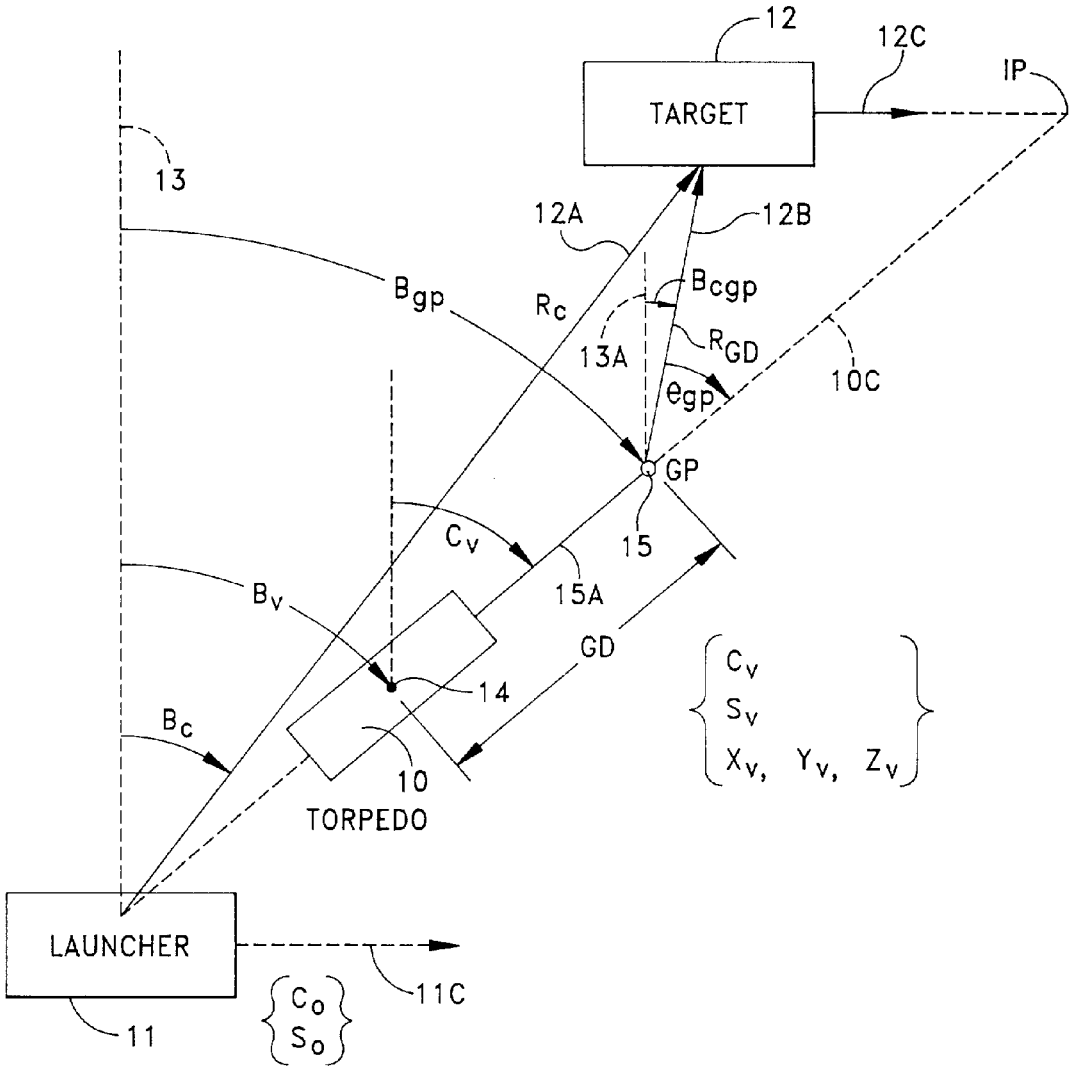
FIG. 1 depicts various instantaneous relationships among a launching vehicle, a target and a steerable object that are useful in understanding this invention.

FIG. 1 depicts an acoustic homing torpedo 10, as an example of a steerable object with an internal acoustic homing device, that is moving from a first site, shown as a launcher 11 or submarine, to intercept a second site, shown as a target 12, or contact at an intercept point IP. The torpedo 10 has a position ($X_V$, $Y_V$ and $Z_V$), a course ($C_V$) and a speed ($S_V$) along a course line 10C. The launcher 11 is moving along a course $C_O$ and at speed $S_O$ as represented by an arrow 11C while the target is moving along an arbitrary course at an arbitrary speed, both of which are unknown and represented by an arrow 12C. Each of the course lines 10C and 11C are normally measured with respect to some reference shown by a dashed line 13 in FIG. 1, typically magnetic north.

In this embodiment the torpedo 10 has a homing apparatus, such as an acoustic homing apparatus. Consequently the guidance control system uses measurements to a center point 14 that represents the center of the torpedo 10 and a guidance point (GP) 15 that corresponds to the centroid of the acoustic beam of the internal acoustic homing device. More specifically, the system uses two bearing angles associated with the torpedo 10. One is a bearing $B_v$ to the center point 14 of the torpedo 10; the other, a bearing $B_{cgp}$ from the guidance point (GP) 15 to the target 12.

Figure 2:
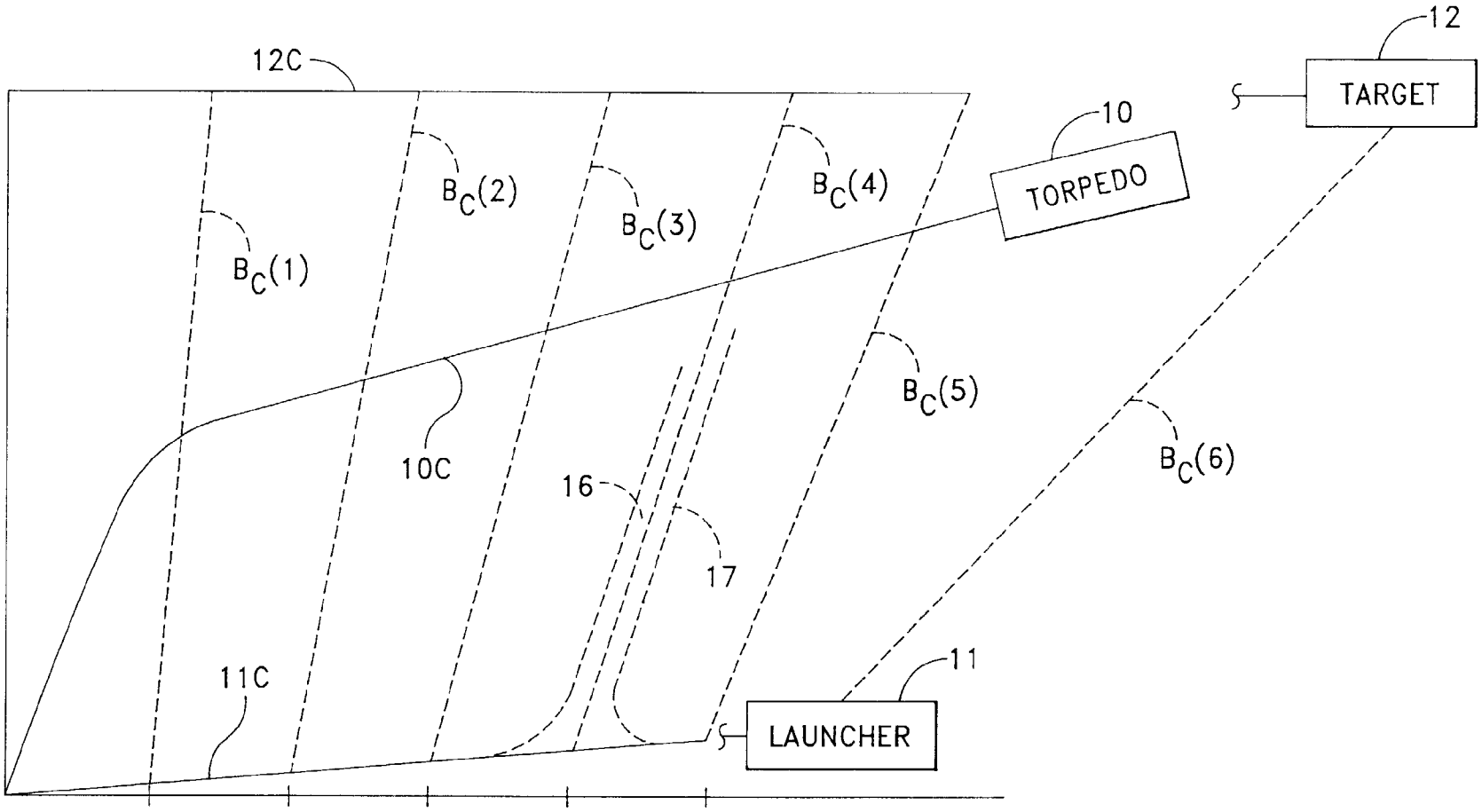
FIG. 2 depicts changes of positions and bearings over time for arbitrary motions of the launching vehicle, a target, a steerable object and a predetermined zone.

As previously indicated, it is possible that the torpedo 10 will, during transit from the launcher 11 to the target 12, approach the bearing line 12A and contaminate the measurements of the sensed bearing to the target 10 from the launcher 11. To avoid this situation and as shown in FIG. 2, the control system defines a "forbidden zone" 16 around each bearing line. In FIG. 2 dashed lines 17 define the boundaries of one such zone. In this particular application, the control system steers the torpedo 10 so that it does not enter this forbidden zone 16. The details of this process are described later. It will become apparent, however, that the target intercept guidance commands may direct the torpedo 10 into this forbidden zone 16 thereby producing a conflict between the goal of target intercept guidance and the goal of maintaining the torpedo at locations removed from the forbidden zone 16. It will also be apparent that the forbidden zone 16 shown in FIG. 2 is a specific example of a zone that can be located at any arbitrary position and which may, in certain circumstances, yield conflicting or competing control operations or goals.

Figure 3:
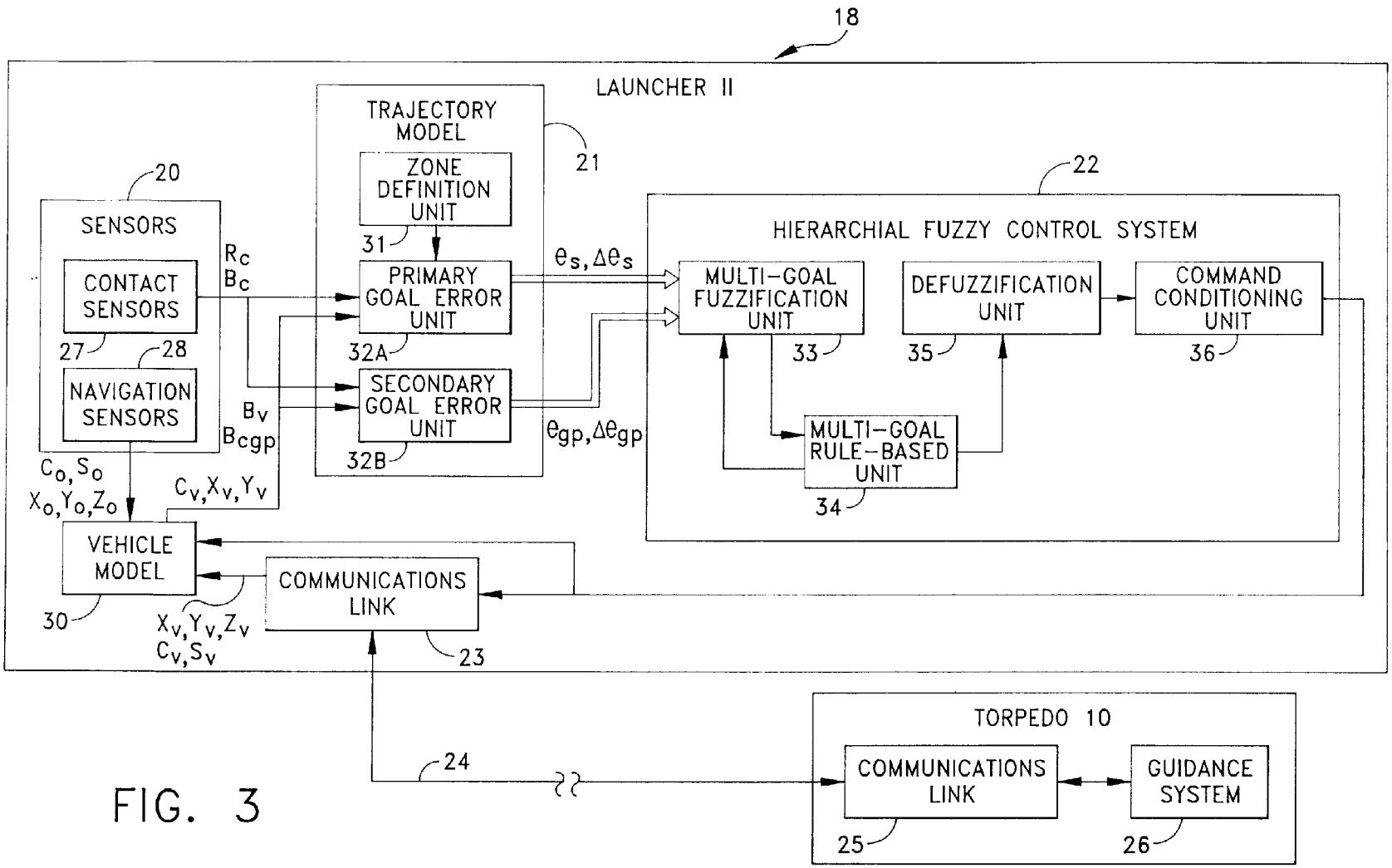
FIG. 3 is a block diagram of a guidance system constructed and operated in accordance with this invention.

Referring now to FIG. 3, a guidance system 18 constructed in accordance with this invention includes sensors 20 that measure various parameters associated with the target 12 and the launcher 11. A trajectory model 21 processes data from the sensors 20 and generates a set of error functions for a hierarchical fuzzy control system 22 that classifies each of the error functions (as a plurality of sensed variables) based on competing goals into one or more goal sensed linguistic variables from corresponding sets of predetermined goal sensed linguistic variables based upon their associated goal sensed variable membership functions. This hierarchical fuzzy control system 22 logically combines the goal selected sensed linguistic variables for identifying one or more control output linguistic variables and corresponding control output membership functions from a control output membership function set. The control system 22 also converts the selected control output membership function or functions into a guidance command. A communications link 23 transfers the guidance command over a bidirectional communications channel 24, typically formed by a wire connected to the torpedo 10, to another communications link 25 and a guidance system 26 in the torpedo 10.

Figure 4A:
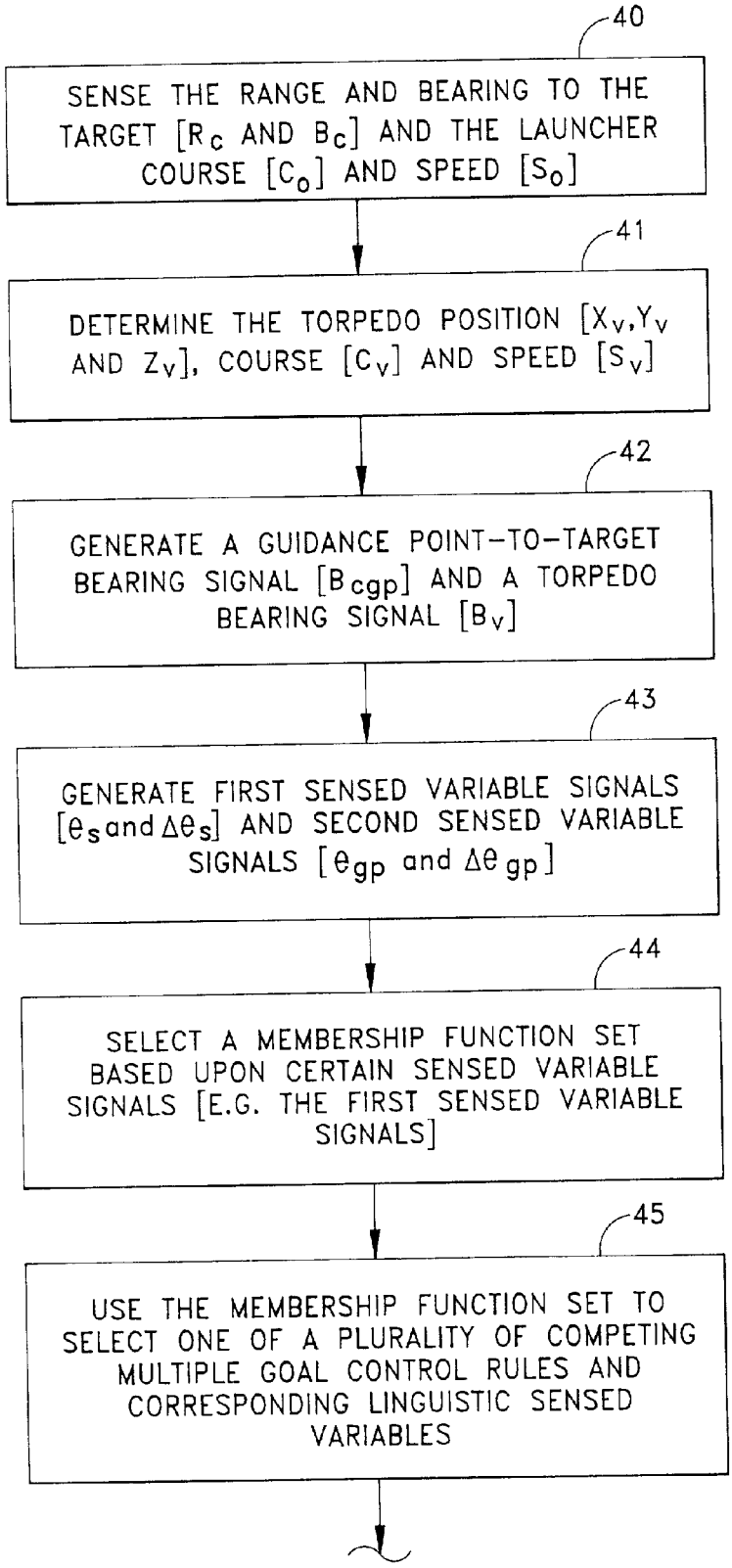
FIGS. 4A and 4B constitute a flow diagram that depicts the operation of the guidance system in FIG. 3.

Referring to FIGS. 1 and 3, the sensors 20 include contact sensors 27 that produce a range $R_c$ and a bearing $B_C$ defined by the angle between the reference 13 and a line 12A to the target 12. As shown in FIG. 4A, this activity occurs during step 40 wherein navigation sensors 28 of FIG. 3 produce the location of the launching vehicle, $X_O$, $Y_O$ and $Z_O$ as well as its course $C_O$ and speed $S_O$. In step 41 (FIG. 4A) a vehicle model 30 (FIG. 3) provides the position ($X_V$, $Y_V$ and $Z_V$), course ($C_V$) and speed ($S_V$) of the torpedo 10. This information can be obtained utilizing information supplied by the navigation sensors 28 and open loop or dead reckoning updates to the vehicle model 30 or supplemented with information from the torpedo 10. The vehicle model 30 also receives information from the torpedo 10 through the communications link 23.

Whatever the source of the inputs, the vehicle model 30 produces two signals for a primary goal error unit 32A and a secondary goal error unit 32B. One is a $B_V$ signal that represents the bearing relationship defined by the angle between the reference line 13 in FIG. 1 and a line from the launcher 11 to the center point 14 of the torpedo 10. The second is the $B_{cgp}$ signal that represents the bearing defined by the angle between (1) the reference bearing as shown by the line 13A that is parallel to line 13 and (2) a line from the guidance point 15 to the target 12. This occurs during step 42 in FIG. 4A.

In accordance with certain objects of this invention, it will also be assumed that the hierarchical control system is to operate in accordance with one set of rules when the torpedo 10 lies within a forbidden zone 16 and in accordance with another set of rules when the torpedo 10 lies outside the forbidden zone 16. A primary goal error unit 32A and a zone definition unit 31 produce $e_s$ and $\Delta e_s$ sensed variable signals that, in this particular embodiment, represent, respectively, (a) the angular measure of the amount that the torpedo 10 is inside or outside the forbidden zone 16 and (b) the rate of change of that angular measure. A secondary goal error unit 32B produces $e_{gp}$ and $\Delta e_{gp}$ sensed variable signals that, in this particular embodiment, represent, respectively, (a) instantaneous difference between a bearing $B_{cgp}$ from the guidance point 15 to the target 12 relative to the reference line 13, as shown by parallel reference line 13A and the course $C_v$ of the torpedo 10 and (b) the rate of change of this difference.

More specifically, during step 43 of each iteration of FIG. 4A the error units 32A and 32B in FIG. 3 convert the incoming signals into error signals representing primary and secondary sensed variables as follows:

$$e_s=|B_v-B_c|-\theta_s \quad (1)$$

$$\Delta e_s=|e_s|_k-|e_s|_{k-1} \quad (2)$$

$$e_{gp}=B_{cgp}-C_v \quad (3)$$

and $$\Delta e_{gp}=|B_{cgp}-C_v|_k-B_{cgpk-1}-C_{vk}| \quad (4)$$

wherein $$-90° \leqq B_c \leqq 90° \quad (5)$$

$$-90° \leqq B_v \leqq 90° \quad (6)$$

and wherein $\Theta_s$ is the angular measure with respect to whether the torpedo 10 is inside or outside the forbidden zone 16 in FIG. 2. In this particular embodiment the zone definition unit 31 in FIG. 3 defines that value according to:

$$\theta_s = \theta_m e^{-\frac{r}{c}} \quad (7)$$

where "$\Theta_m$", as shown in FIG. 2, represents a maximum angular separation, generally proximate the launcher 11, "r" represents the range from the launcher 11 to the torpedo 10 and "c" is a constant. It will be apparent that this constitutes but one example of a procedure for defining whether a steerable object, such as a torpedo, is inside or outside a predetermined zone. Other zones can be defined that are in reference to the bearing line or any other relative positions of the torpedo 10, launcher 11 and target 12 or even with respect to an arbitrarily fixed location, such as a predetermined geographical area.

Steps 44 and 45 in FIG. 4A represent a preferred procedure by which the hierarchical control system 22 of FIG. 3 based on competing primary and secondary goals encodes each of either the primary or secondary error signals representing the goal sensed variables into one or more corresponding goal sensed linguistic variables based upon goal sensed variable membership functions from corresponding goal sensed variable membership function sets. In step 44 the fuzzification unit 33 selects a membership function set based upon the sensed variables. In step 45, a multi-goal rule based unit 34 monitors the selected membership function set and determines whether the primary goal or secondary goal is to be used. If those signals indicate that the guidance must proceed according to the primary goal (i.e., to steer the vehicle away from the forbidden zone), the rule based unit 34 returns from fuzzification unit 33 linguistic sensed variables corresponding to the sensed variable signals from the primary goal error unit 32A. If those first sensed variable signals indicate that guidance should proceed according to the secondary goal (i.e., to steer the vehicle toward the target in accordance with the target intercept mode), the rule based unit 34 returns from the fuzzification unit 33 the linguistic sensed variables corresponding to the sensed variable signals from the secondary goal error unit 32B.

Figure 5A:
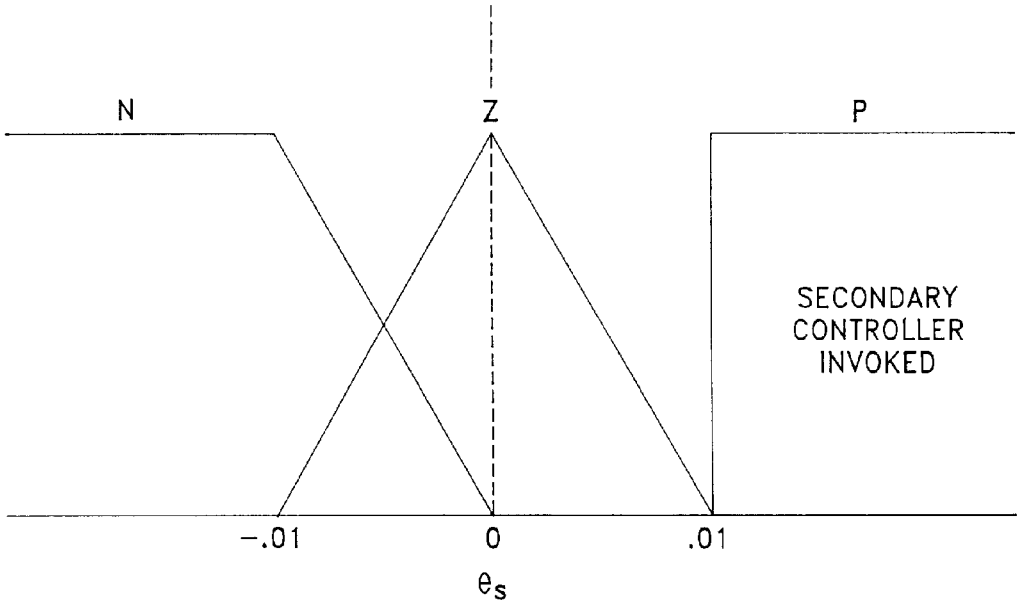
FIGS. 5A, 5B, 5C, 5D and 5E are graphical representations of linguistic variables and their associated membership function sets that are useful in understanding this invention.
Figure 5B:
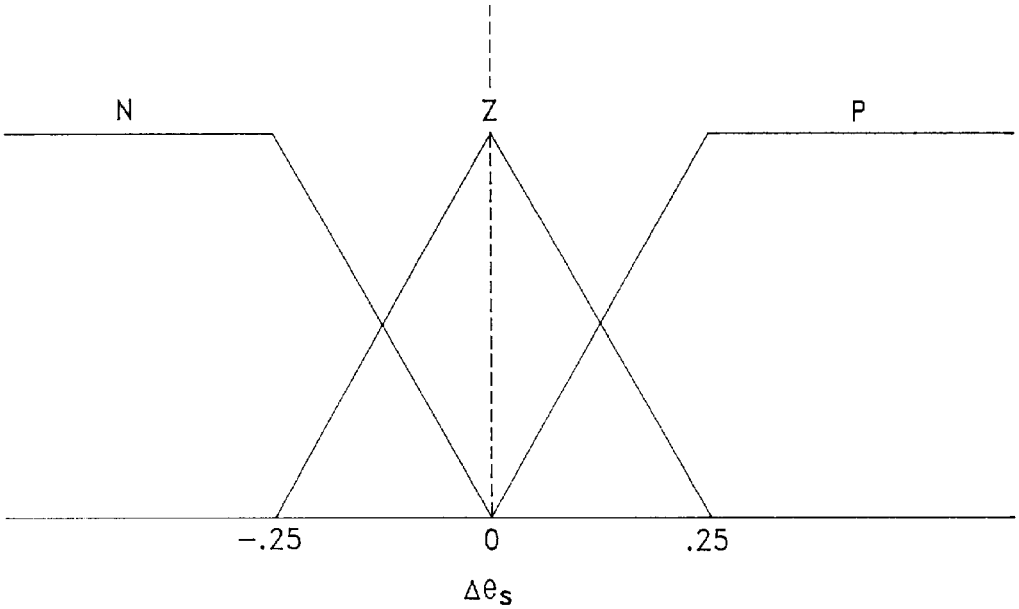
Figure 5C:
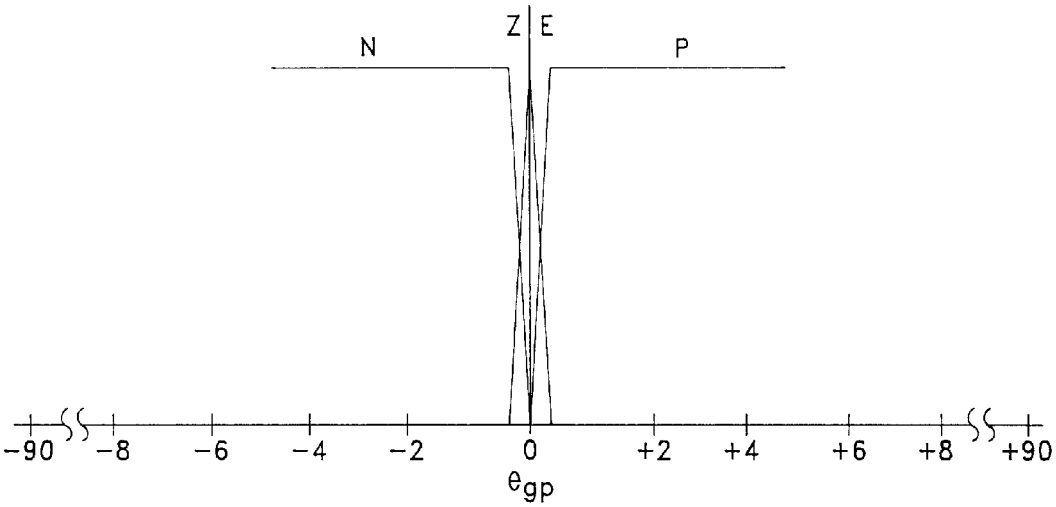

FIG. 5A, for example, discloses an $e_s$ sensed variable membership function set with three sensed variable membership functions and their corresponding sensed $e_s$, or "angular error" linguistic variables while FIG. 5B discloses three $\Delta e_s$ sensed variable membership functions and their corresponding sensed $\Delta e_s$, or "angular error rate of change" linguistic variables. FIG. 5C discloses an $e_{gp}$ sensed variable membership function set with three sensed variable membership functions and their corresponding sensed $e_{gp}$ "intercept angle" linguistic variables while FIG. 5D discloses an $\Delta e_{gp}$ sensed variable membership function set with seven $\Delta e_{gp}$ sensed variable membership functions and their corresponding sensed $\Delta e_{gp}$ "intercept angle rate of change" linguistic variables.

In the following discussion the primary goal error unit 32A in FIG. 3 and the secondary goal error unit 32B produce the foregoing $e_s$ and $\Delta e_s$ signals as primary error signals, or first sets of sensed variable signals and the $e_{gp}$ and $\Delta e_{gp}$ signals as secondary error signals, or second sets of sensed variable signals respectively. It will be assumed that the following relationships exist:

$$x1=e_{gp} \quad (8)$$

$$x2=\Delta e_{gp} \quad (9)$$

$$x3=e_s \quad (10)$$

and $$x4=\Delta e_s \quad (11)$$

and that a multi-goal fuzzification unit 33 in FIG. 3 uses the $e_s$ and $\Delta e_s$ signals to select one or more of the three available "angular error" ($e_s$) and "angular error rate of change" ($\Delta e_s$) sensed linguistic variables or uses the $e_{gp}$ signals to select one or more of the three available "intercept angle" ($e_{gp}$) sensed linguistic variables and the $\Delta e_{gp}$ signal to select one or more of seven available "intercept angle rate of change" sensed linguistic variables. The possibilities in this particular embodiment, that includes secondary goal "intercept angle" and "intercept angle rate of change" linguistic variables $T_{x1}$ and $T_{x2}$ respectively and the primary goal "angular error" and "angular error rate of change" linguistic variables $T_{x3}$ and $T_{x4}$, respectively can be designated as:

$$T(x1) = (T^1{}_{X1}, T^2{}_{x1}, T^3{}_{x1}) = (N, ZE, P) \quad (12)$$

$$T(x2) = (T^1{}_{X2}, T^2{}_{x2}, T^3{}_{x2}, T^4{}_{x2}, T^5{}_{x2}, T^6{}_{x2}, T^7{}_{x2}) = (NL, NM, NS, ZE, PS, PM, PL) \quad (13)$$

$$T(x3) = (T^1{}_{X3}, T^2{}_{x3}, T^3{}_{x3}) = (N, Z, P) \quad (14)$$

and $$T(x4) = (T^1{}_{X4}, T^2{}_{x4}, T^3{}_{x4}) = (N, Z, P) \quad (15)$$

where "NL", "NS", "NM", "ZE", "PS", "PM", and "PL" denote Negative Large, Negative Small, Negative Medium, Zero, Positive Small, Positive Medium, and Positive Large sensed linguistic variables, respectively. "N", "Z" and "P" denote Positive, Zero and Negative sensed linguistic variables, respectively.

The specific set of membership functions $\mu$(x1) and $\mu$(x2) corresponding to inputs x1 and x2 and the "intercept angle" and "intercept angle rate of change" linguistic variables associated with the secondary goal and shown in FIGS. 5C and 5D, can be mathematically stated as follows:

$$\mu(x1)=(\mu^1{}_{x1}, \mu^2{}_{x1}, \mu^3{}_{x1}) \quad (16)$$

and $$\mu(x2)=(\mu^1{}_{x2}, \mu^2{}_{x2}, \mu^3{}_{x2}, \mu^4{}_{x2}, \mu^5{}_{x2}, \mu^6{}_{x2}, \mu^7{}_{x2}). \quad (17)$$

For j=2 and i=2,3,4,5,6 and for j=1 and i=2:

$$\mu^i_{xj} = 1 - \frac{(|xj - C^i_{xj}|)}{\delta^i_{xj}} \tag{18}$$

for $$C^i_{xj} - \delta^i_{xj} \leqq xj \leqq C^i_{xj} + \delta^i_{xj} \tag{19}$$

and $$\mu^i_{xj} = 0 \tag{20}$$

for $$C^i_{xj} - \delta^i_{xj} > xj > C^i_{xj} + \delta^i_{xj} \tag{21}$$

The end conditions, j=1 and i=1,3 and j=2 and i=1,7 are defined by the following equations:

$$\mu^i_{xj} = 1 - \frac{(|xj - C^i_{xj}|)}{\delta^i_{xj}} \tag{22}$$

for $$a^i C^i_{xj} \geqq a^i xj \geqq a^i (C^i_{xj} - a^i \delta^i_{xj}) \tag{23}$$

and $$\mu^i_{xj} = 1 \tag{24}$$

for $$a^i C^i_{xj} < a^i xj \tag{25}$$

and $$\mu^i_{xj} = 0 \tag{26}$$

for $$a^i (C^i_{xj} - a^i \delta^i_{xj}) > a^i xj \tag{27}$$

where $a^i$=1, except for i=1 where $a^1$=−1.

The specific set of membership functions $\mu$(x3) and $\mu$(x4) corresponding to inputs x3 and x4 and the "angular error" and "angular error rate of change" sensed linguistic variables associated with the primary goal and shown in FIGS. 5A and 5B, can be mathematically stated as follows:

$$\mu(x3) = (\mu^1_{x3}, \mu^2_{x3}, \mu^3_{x3}) \tag{28}$$

and $$\mu(x4) = (\mu^1_{x4}, \mu^2_{x4}, \mu^3_{x4}) \tag{29}$$

For j=3 and i=2 and for j=4 and i=2

$$\mu^i_{xj} = 1 - \frac{(|xj - C^i_{xj}|)}{\delta^i_{xj}} \tag{30}$$

for $$C^i_{xj} - \delta^i_{xj} \leqq xj \leqq C^i_{xj} + \delta^i_{xj} \tag{31}$$

and $$\mu^i_{xj} = 0 \tag{32}$$

for $$C^i_{xj} - \delta^i_{xj} > xj > C^i_{xj} + \delta^i_{xj} \tag{33}$$

For j=3 and i=1 and for j=4 and i=1,3:

$$\mu^i_{xj} = 1 - \frac{(|xj - C^i_{xj}|)}{\delta^i_{xj}} \tag{34}$$

for $$a^i C^i_{xj} \geqq a^i xj \geqq a^i (C^i_{xj} - a^i \delta^i_{xj}) \tag{35}$$

and $$\mu^i_{xj} = 1 \tag{36}$$

for $$a^i C^i_{xj} < a^i xj \tag{37}$$

and $$\mu^i_{xj} = 0 \tag{38}$$

for $$a^i (C^i_{xj} - a^i \delta^i_{xj}) > a^i xj \tag{39}$$

where $a^i$=1, except for i=1 where $a^1$=−1.

For j=3 and i=3

$$\mu^i_{xj} = 1 \tag{40}$$

for $$C^i_{xj} \leqq xj \tag{41}$$

and $$\mu^i_{xj} = 0 \tag{42}$$

for $$C^i_{xj} > xj \tag{43}$$

FIG. 5A depicts graphically the relationship of each "angular error" linguistic variable and associated membership function in the $e_s$ membership function set for different values of the $e_s$ signal according to a specific set of values for $C^i_{xj}$ and $\delta^i_{xj}$.FIG. 5B presents analogous information for the $\Delta e_s$ signal. In the specific embodiment shown in FIGS. 5A and 5B certain incoming signals correspond to a single or multiple sensed "angular error" and "angular error rate" linguistic variables based upon corresponding membership functions. For example, in FIG. 5A the $e_s$ membership function set is used to encode an $e_s$ signal having a value 0 only into a Z linguistic sensed "angular measure error" variable whereas a value of about −0.005 is encoded into both Z and N sensed "angular error" linguistic variables by using the $e_s$ membership function set. Likewise the "angular error rate of change" membership set in FIG. 5B encodes a signal $\Delta e_s$=0.3 into a P sensed "angular error rate of change" linguistic variable and a signal $\Delta e_s$=0.1 into both Z and P sensed "angular error rate of change" linguistic variables.

FIG. 5C similarly depicts graphically the relationship of each "intercept angle" sensed linguistic variable and associated membership function in the $e_{gp}$ membership function set for different values of the $e_{gp}$ signal according to another specific set of values for $C^i_{xj}$ and $\delta^i_{xj}$. FIG. 5D presents corresponding information for the $\Delta e_{gp}$ signal. In the specific embodiment shown in FIGS. 5C and 5D certain incoming signals may also correspond to a single or multiple "intercept angle" and "intercept angle rate of change" sensed linguistic variables based upon corresponding membership functions.

Figure 4B:
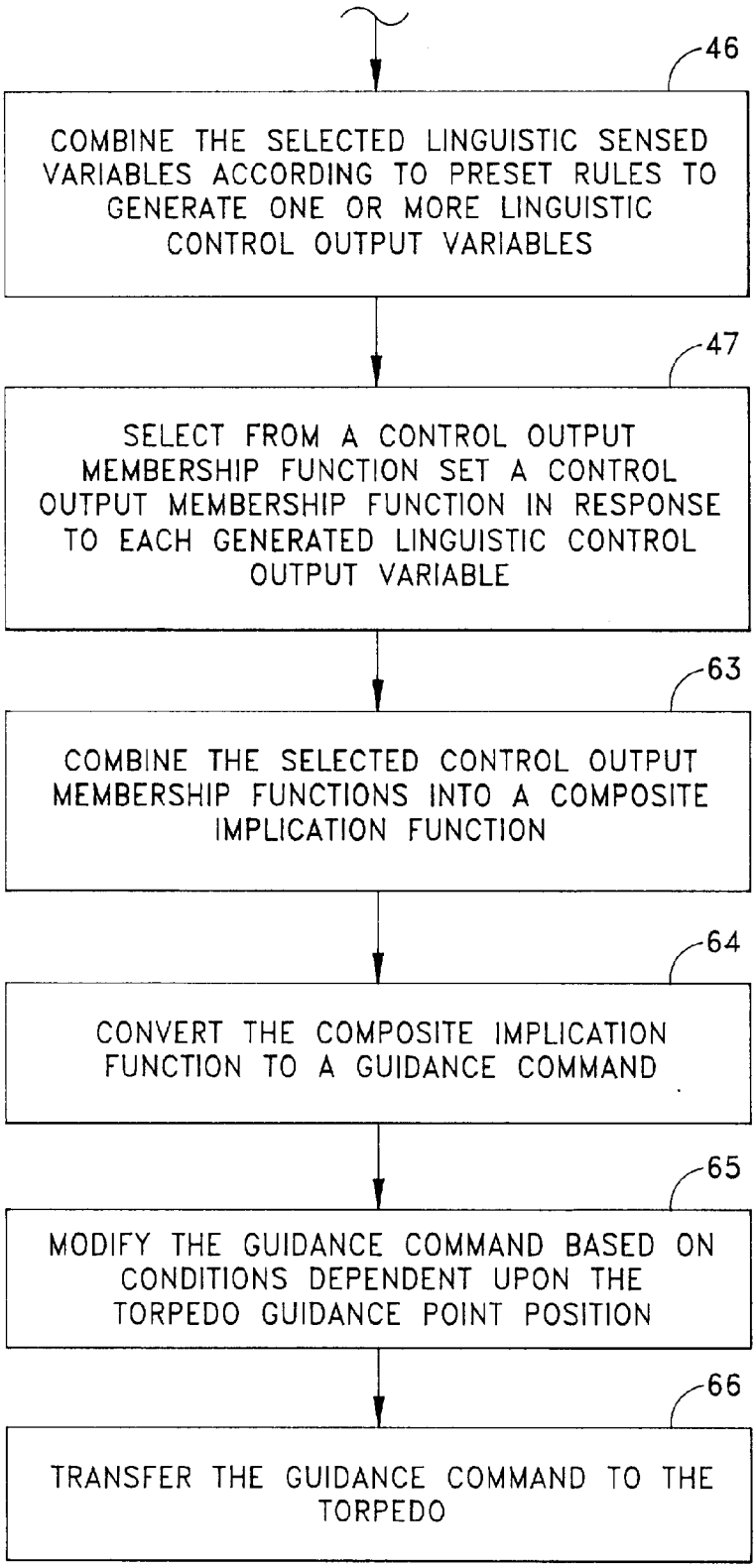
Figure 5E:
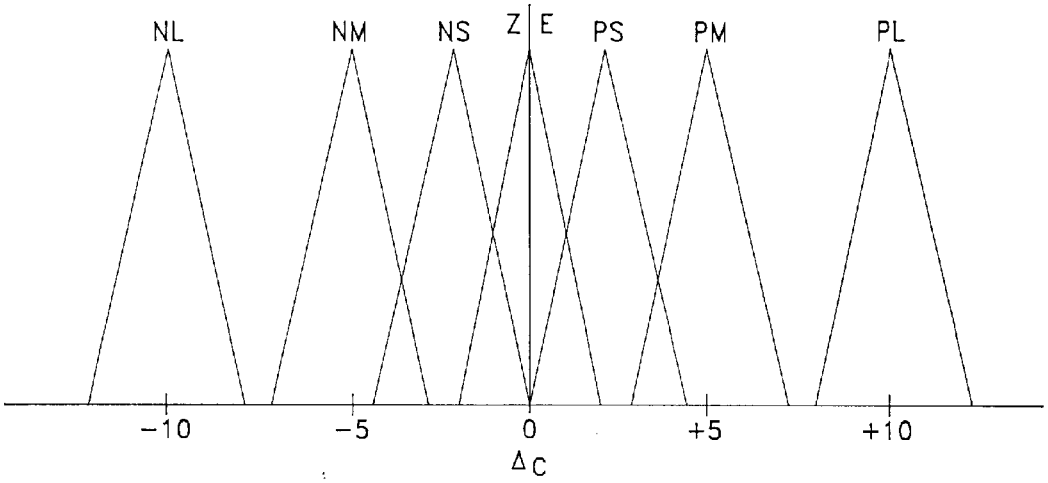
Figure 6:
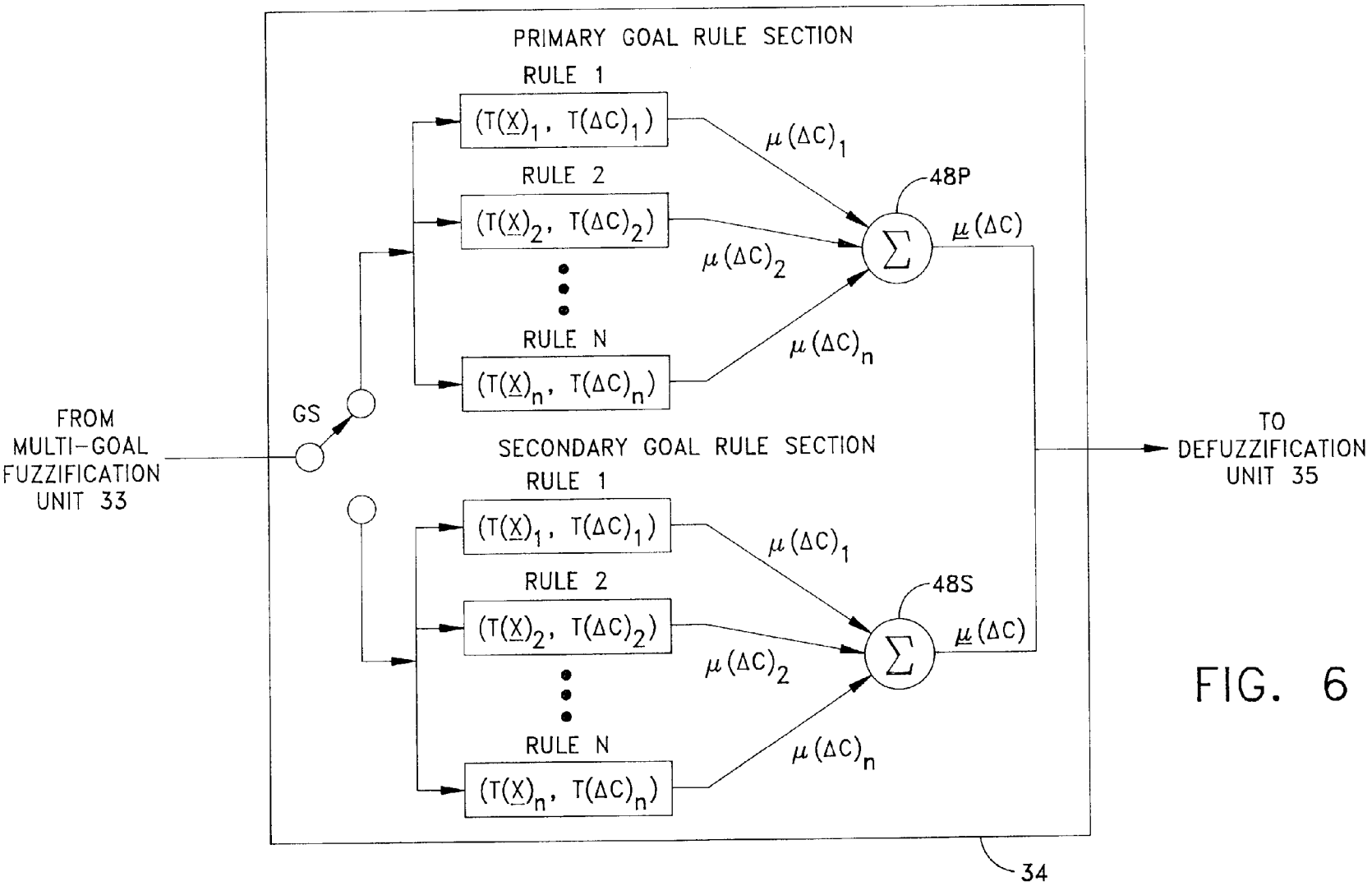
FIG. 6 schematically represents a multi-goal rule based unit shown in FIG. 3.

Referring to step 46 in FIG. 4B, the multi-goal rule based unit 34 in FIGS. 3 and 6 combines certain selected sensed linguistic variables to produce one or more control output linguistic variables in response to the hierarchical control described in steps 44 and 45 of FIG. 4A. Each selected control output linguistic variable corresponds to a predefined membership function in a control output membership function set (FIG. 5E). More specifically, each control output linguistic variable is determined according to a set of rules defined in FIGS. 7A, 7B and 7C. The control outputs include, in this specific embodiment, seven control output linguistic variables defined as:

$$T(\Delta C) = (T^1{}_{\Delta C}, T^2{}_{\Delta C}, T^3{}_{\Delta C}, T^4{}_{\Delta C}, T^5{}_{\Delta C}, T^6{}_{\Delta C}, T^7{}_{\Delta C}) = (NL, NM, NS, ZE, PS, PM, PL). \quad (44)$$

The corresponding control output membership functions, ($\mu(\Delta C)$) are:

$$\mu(\Delta C)=\{\mu^1{}_{\Delta C}, \mu^2{}_{\Delta C}, \mu^3{}_{\Delta C}, \mu^4{}_{\Delta C}, \mu^5{}_{\Delta C}, \mu^6{}_{\Delta C}, \mu^7{}_{\Delta C}\} \quad (45)$$

and shown in FIG. 5E and can be defined mathematically for i=1,2,3,4,5,6,7 by $$\mu^i{}_{\Delta C} = 1 - \frac{(|\Delta C - C^i{}_{\Delta C}|)}{\delta^i{}_{\Delta C}} \quad (46)$$

for $$C^i{}_{\Delta C}-\delta^i{}_{\Delta C}\leq\Delta C\leq C^i{}_{\Delta C}+\delta^i{}_{\Delta C} \quad (47)$$

and by $$\mu^i{}_{\Delta C}=0 \quad (48)$$

for $$C^i{}_{\Delta C}-\delta^i{}_{\Delta C}>\Delta C>C^i{}_{\Delta C}+\delta^i{}_{\Delta C} \quad (49)$$

Values for the various constants $C^i$ and $\delta^i$ are associated with different membership functions of the sensed variable and control output variable membership function sets.

If $\mu(x1)$ and $\mu(x2)$ represent the sensed variable membership function sets associated with the secondary goal error unit 32B in FIG. 3 and $\mu(\Delta C)$ represents the output control membership function set, the following constants can also be used:

| | $\mu(x1)$ | | $\mu(x2)$ | | $\mu(\Delta C)$ | |
|---|---|---|---|---|---|---|
| i | $C^i{}_{x1}$ | $\delta^i{}_{x1}$ | $C^i{}_{x2}$ | $\delta^i{}_{x2}$ | $C^i{}_{\Delta C}$ | $\delta^i{}_{\Delta C}$ |
| 1 | −0.5 | 0.5 | −0.12 | 0.04 | −10.00 | 2 |
| 2 | 0.0 | 0.5 | −0.07 | 0.03 | −5.0 | 2 |
| 3 | 0.5 | 0.5 | −0.03 | 0.03 | −2.0 | 2 |
| 4 | | | 0 | 0.01 | 0.0 | 2 |
| 5 | | | 0.03 | 0.03 | 2.0 | 2 |
| 6 | | | 0.07 | 0.03 | 5.0 | 2 |
| 7 | | | 0.12 | 0.04 | 10.0 | 2 |

Similarly if $\mu(x3)$ and $\mu(x4)$ represent the sensed variable membership function sets associated with the "angular error" and "angular error rate of change" sensed variables for the primary goal membership functions, a control system constructed in accordance with this invention can operate with the following constants:

| | $\mu(x3)$ | | $\mu(x4)$ | |
|---|---|---|---|---|
| i | $C^i{}_{x3}$ | $\delta^i{}_{x3}$ | $C^i{}_{x4}$ | $\delta^i{}_{x4}$ |
| 1 | −0.01 | 0.01 | −0.25 | 0.25 |
| 2 | 0 | 0.01 | 0 | 0.25 |
| 3 | 0.01 | — | 0.25 | 0.25 |

As previously indicated, the multi-goal rule based unit 34 of FIGS. 3 and 6 operates according to a primary set of rules that are invoked whenever the torpedo 10 in FIG. 1 enters or approaches the forbidden zone 16 of FIG. 2 or according to a secondary set of rules that are invoked whenever the torpedo 10 is reasonably displaced from the forbidden zone 16. Thus as the torpedo 10 begins to move close to the forbidden zone 16, the $e_s$ signal will be positive and the multi-goal fuzzification unit will select the Z linguistic variable from the $e_s$ membership set shown in FIG. 5A and, assuming a rate of change that is greater than 0.25, will select the P linguistic variable from the $\Delta e_s$ membership set shown in FIG. 5B. Assuming the $B_v-B_c$ is positive, the multi-goal rule based unit 34 will operate, as shown in FIG. 6, with a primary goal selection, represented by the position of a goal switch GS, and use the matrix in FIG. 7A to select a ZE control output linguistic variable.

So long as the torpedo 10 is within the forbidden zone or close to the forbidden zone, as defined by a value of the $e_s$ sensed variable that is less than 0.01 in this specific embodiment, the multi-goal rule based unit 34 relies entirely on the matrices in FIGS. 7A and 7B to select the control output linguistic variables to be used in steering the torpedo 10 out of or away from the forbidden zone 16 in FIG. 2 associated with the current target bearing $B_c$. The matrix in FIG. 7A is selected when $B_v-B_c>0$; the matrix in FIG. 7B, when $B_v-B_{c<}0$.

Whenever the torpedo 10 is far enough outside the forbidden zone, as represented when the $e_s$ signal has a value greater than 0.01 in this embodiment, the selection of the control output linguistic variable is based on the matrix shown in FIG. 7C and rules shown in FIG. 6. For example, if the multi-goal fuzzification unit 33 classifies the $e_s$ signal into a P linguistic variable and classifies the $e_{gp}$ and $\Delta e_{gp}$ signals as Negative (N) and Negative Large (NL) sensed linguistic variables, respectively, the multi-goal rule based unit 34 will generate a positive large (PL) control output linguistic variable.

When generating a command based upon the primary goal or secondary goal criteria, the multi-goal rule based unit 34 in FIGS. 3 and 6 utilizes either the possible combinations for the given primary or secondary set of readings based on competing primary or secondary goals to produce an output based upon the selection of one or more control output membership functions. That is, the multi-goal rule based unit 34 will use the matrices of FIGS. 7A and 7B when the torpedo 10 is in or proximate the forbidden zone 16 or the matrix of FIG. 7C when the torpedo is at any other position. More specifically, if $e_s>0.01$ and if $e_{gp}=+0.3$ and $\Delta e_{gp}=0.05$, the $e_{gp}$ signals can be classified both as ZE and P sensed "intercept angle" linguistic variables based upon the x1 or $e_{gp}$ membership function set of FIG. 5C while the $\Delta e_{gp}$ signal is encoded into PS and PM "intercept angle rate of change" sensed linguistic variables based upon the x2 or $\Delta e_{gp}$ membership function set of FIG. 5D.

Each of the summing circuits 48P and 48S, symbolically referenced in FIG. 6, essentially combines each of the output variable membership functions corresponding to each of the selected control output linguistic variables to produce an output signal as shown by steps 47 and 63 in FIG. 4B. More specifically, the summing circuits 48P and 48S in FIG. 6 combine the selected control output membership functions scaled by the various sensed variable signals as illustrated in FIGS. 8 and 9.

FIGS. 8A through 8E, depict the operation that occurs when the primary goal error unit 32A generates "angular error" and "angular error rate of change" signals of $e_s$=−0.005 and $\Delta e_s$=−0.2 indicating that the torpedo is within the forbidden zone 16. During the selection of the corresponding sensed linguistic variables, the multi-goal fuzzification unit 33 correlates each of the $e_s$ and $\Delta e_s$ sensed variables into a particular point on any corresponding encoding sensed variable membership function as shown by FIGS. 8A through 8D. In this particular embodiment, for example, the $e_s$ signal intersects both the Z and N membership functions shown in FIG. 5A and the $\Delta e_s$ signal intersects the Z and N membership functions shown in FIG. 5B. The multi-goal rule based unit 34 then selects one output control linguistic variable for each possible logical combination of the sensed variable linguistic variables. In this particular example, each signal corresponds to two membership functions, so the multi-goal rule based unit 34 executes four rules and selects four control output linguistic variables. The summing unit 48P scales each selected control output membership function through the selection of the lower of the intercepts of the input signals with the corresponding sensed variable membership functions incorporated in a specific rule.

Figure 8E:
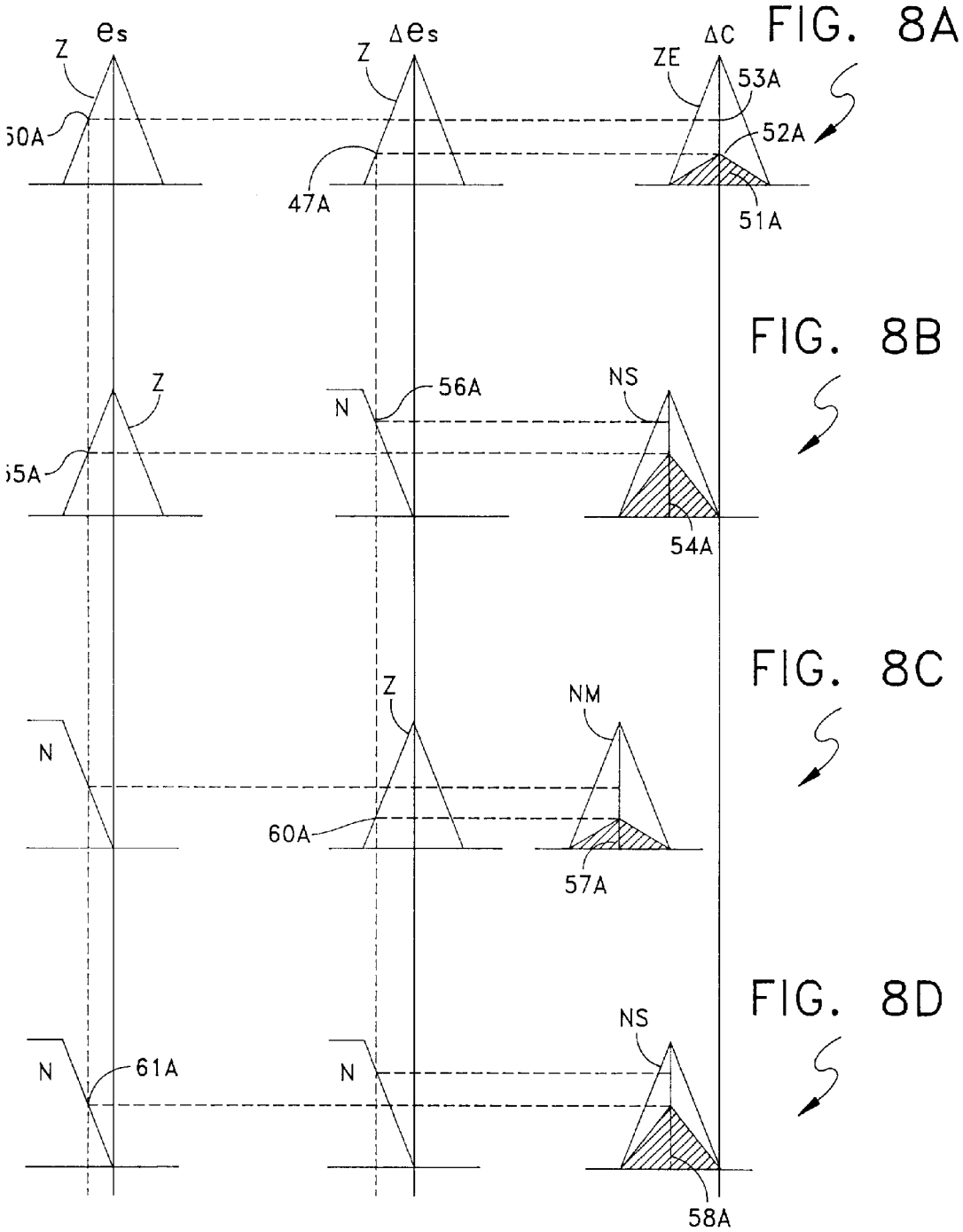
Figure 8E:
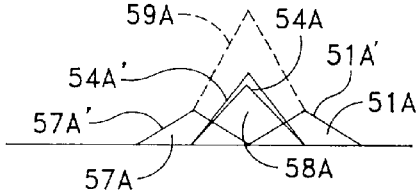

Using FIGS. 8A through 8E as an example and assuming that the torpedo is inside the forbidden zone and that $B_v-B_c<0$, the multi-goal rule based unit 34 operates according to the matrix in FIG. 7B. In FIG. 8A the $e_s$ and $\Delta e_s$ signals are shown as intersecting the Z linguistic variables for each so the multi-goal rule based unit 34 selects the ZE control output linguistic variable according to the rule:

If $e_s$ is Z and $\Delta e_s$ is Z THEN ΔC is ZE

FIGS. 8B through 8D define the other three rules that the multi-goal rule based unit 34 invokes under the remaining three logical combinations as follows:

IF $e_s$ is Z and $\Delta e_s$ is N THEN ΔC is NS

IF $e_s$ is N and $\Delta e_s$ is Z THEN ΔC is NM

IF $e_s$ is N and $\Delta e_s$ is N THEN ΔC is NS

FIGS. 8A through 8D also depict graphically one approach for combining the selected control output linguistic variables for producing a command signal. In Graph 8A, an intersection 47A of the $\Delta e_s$ signal with its Z membership function is lower than an intersection 50A of the $e_s$ signal with its selected Z membership function, so the $\Delta e_s$ signal controls the magnitude of the selected ZE control output membership function by establishing a scaled triangular output function 51A with its peak at intersection 52A rather than the intersection 53A. In a similar fashion, the second rule depicted in Graph 8B produces a triangular form 54A based upon an intersection 55A of the $e_s$ signal with the Z sensed variable membership function that is lower than an intersection 56A of the $\Delta e_s$ signal with its corresponding N membership function. Similarly the rules depicted in Graphs 8C and 8D provide triangular forms 57A and 58A respectively based upon a lower intersection 60A of the $\Delta e_s$ signal in FIG. 8C and upon a lower intersection 61A of the $e_s$ signal in FIG. 8D.

Figure 5D:
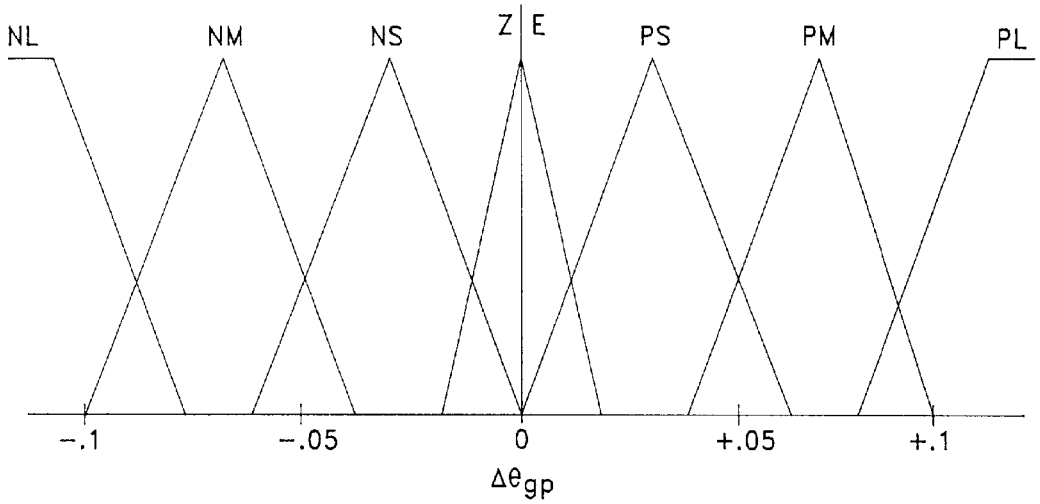

Whenever the $e_s$ primary goal error unit produces a sensed variable signal that identifies the P linguistic variable indicating that the torpedo 10 is outside the forbidden zone 16, the multi-goal rule based unit 34 operates in response to the $e_{gp}$ and $\Delta e_v$ sensed variable signals according to the membership functions shown in FIGS. 5C and 5D and the matrix shown in FIG. 7C. FIGS. 9A through 9E graphically depicts the formation of the composite control output function under these operating conditions for each of four input combinations and correlations as shown in Graphs 9A through 9D respectively, as for example, when $e_{gp}$ has a value that identifies P and ZE membership functions and $\Delta e_{gp}$ identifies ZE and PS membership functions.

The multi-goal rule based unit 34 correlates each of the possible four input combinations for the secondary goal as follows:

IF $e_{gp}$ is ZE AND $\Delta e_{gp}$ is ZE THEN ΔC is ZE.

IF $e_{gp}$ is ZE AND $\Delta e_{gp}$ is PS THEN ΔC is NS.

IF $e_{gp}$ is P AND $\Delta e_{gp}$ is ZE THEN ΔC is ZE.

IF $e_{gp}$ is P AND $\Delta e_{gp}$ is PS THEN ΔC is PS.

Thus in step 45 the multi-goal rule based unit 34 produces different output consequences or control output linguistic variables derived from these selected rules.

In the case of the first rule shown in FIG. 9A, an intersection 47B of the $\Delta e_{gp}$ signal with ZE membership function is lower than the intersection 50B of the $e_{gp}$ signal with its selected Z membership function, so the $\Delta e_{gp}$ signal controls the magnitude of the selected ZE control output membership function by establishing a scaled triangular output function 51B with its peak at intersection 52B rather than the intersection 53B. In a similar fashion, the multi-goal rule based unit 34 produces triangular forms 54B, 57B and 58B respectively.

Stated mathematically, multi-goal rule based unit 34 produces outputs for up to a maximum of four inferred control output functions from each of the identified rules. For example, these functions, for the set resulting from the operation of the secondary error unit 32B are, respectively, (1) $\xi_{(1)}\mu^4_{\Delta C}$, (2) $\xi_{(2)}\mu^3_{\Delta C}$, (3) $\xi_{(3)}\mu^4_{\Delta C}$ and (4) $\xi_{(4)}\mu^5_{\Delta c}$ where:

$\xi_{(1)}\mu^4_{\Delta C}=\mu(\Delta C)_{(1)}$=the control output function for rule 1 defined by $\mu^4_{66\ C}$ multiplied by the value $\xi_{(1)}$; and $\xi_{(2)}\mu^3_{\Delta C}=\mu(\Delta C)_{(2)}$=the control output function for rule 2 defined by $\mu^3_{\Delta C}$ multiplied by the value $\xi_{(2)}$.

$\xi_{(3)}\mu^4_{\Delta C}=\mu(\Delta C)_{(3)}$=the control output function for rule 3 defined by $\mu^4_{\Delta C}$ multiplied by the value $\xi_{(3)}$ and $\xi_{(4)}\mu^5_{\Delta C}=\mu(\Delta C)_{(4)}$=the control output function for rule 4 defined by $\mu^5_{\Delta C}$ multiplied by the value $\xi_{(4)}$;

and $$\xi_{(1)}=Y_{x1}{}^2\Lambda Y_{x2}{}^4=\min\ (Y_{x1}{}^2,\ Y_{x2}{}^4) \tag{48}$$

$$\xi_{(2)}=T_{x1}{}^2\Lambda Y_{x2}{}^5=\min\ (Y_{x1}{}^2,\ Y_{x2}{}^5) \tag{49}$$

$$\xi_{(3)}=Y_{x1}{}^3\Lambda Y_{x2}{}^4=\min\ (Y_{x1}{}^3,\ Y_{x2}{}^4) \tag{50}$$

$$\xi_{(4)}=Y_{x1}{}^3\Lambda Y_{x2}{}^5=\min\ (Y_{x1}{}^3,\ Y_{x2}{}^5) \tag{51}$$

where $Y_{xj}{}^i$ is $\mu_{xj}{}^i$ evaluated at a specific sensed input xj(t) at time "t" and where "Λ" denotes a fuzzy minimum. The control output composite implication function, $\underline{\mu}(\Delta C)$, of the multi-goal rule based unit 34 for this example is expressed as:

$$\underline{\mu}(\Delta C)=\mu(\Delta C)_{(1)}+\mu(\Delta C)_{(2)}+\mu(\Delta C)_{(3)}+\mu(\Delta C)_{(4)} \tag{52}$$

The inferred control output functions are generated in a similar fashion for the primary error unit example.

Figure 9E:
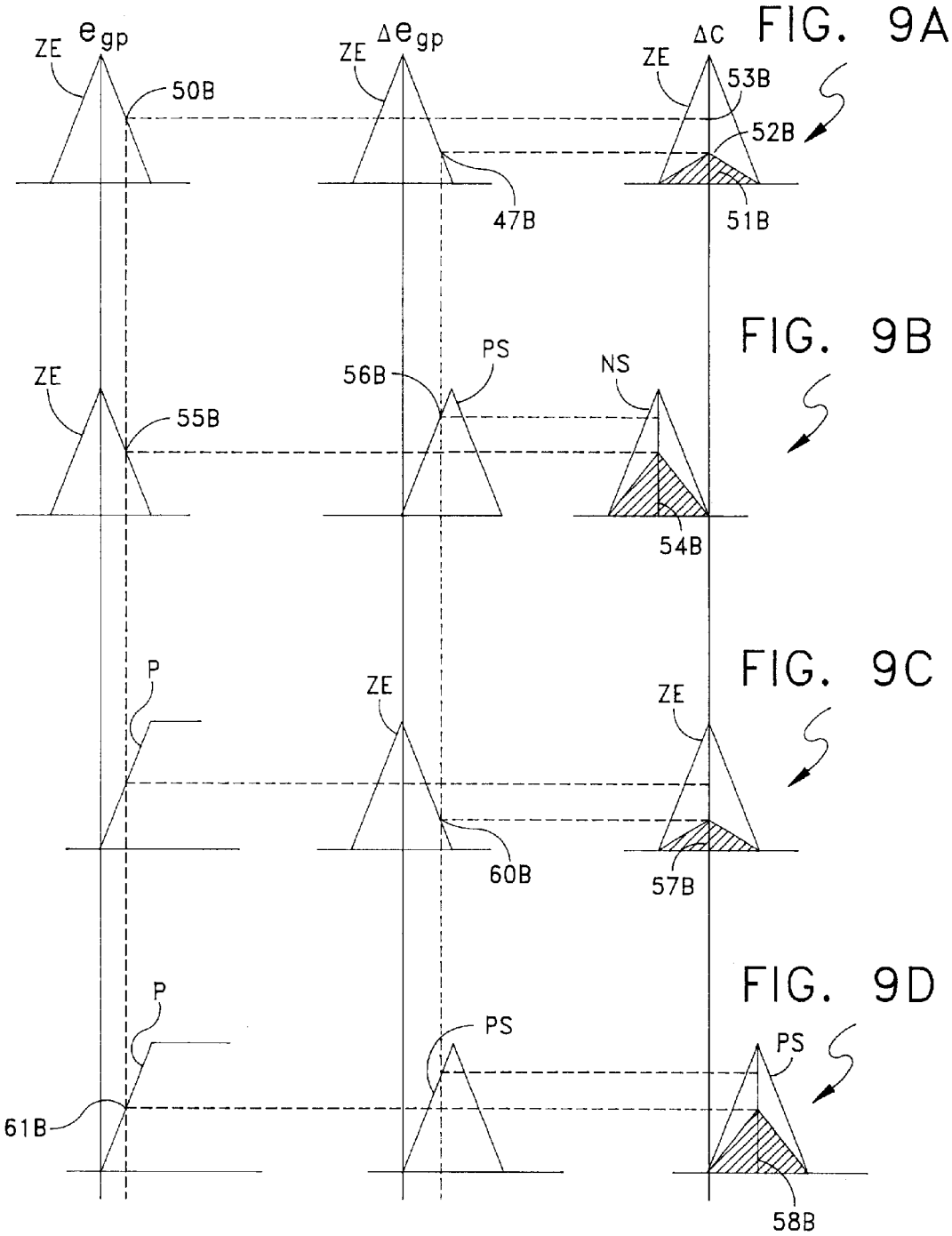
Figure 9E:
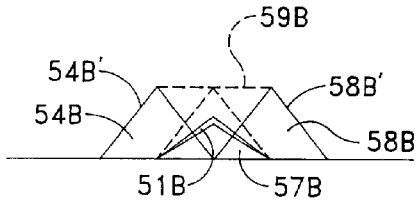

As previously indicated, the ruled based unit 34 in FIGS. 3 and 6 also operates in accordance with step 63 of FIG. 4B by combining the scaled fuzzy output membership functions shown in FIG. 8E or FIG. 9E into a composite output function. A number of methods can be utilized for converting composite outputs into guidance commands in step 64. The defuzzification unit 35 for example, can use a centroid method to provide guidance commands. Mathematically the centroid is computed as follows:

$$\Delta C = \frac{\sum_k \left[ \left( \zeta_{(k)} C_{\Delta C_{(k)}} \right) I_{\Delta C_{(k)}} \right]}{\sum_k \zeta_{(k)} I_{\Delta C_{(k)}}} \tag{53}$$

where $\Sigma_{(k)}$ is the summation over all the rules selected by the multi-goal rule based unit 34 and $I_{\Delta C(k)}$ and $C_{\Delta C(k)}$ are the respective area and centroid of the kth rule consequent set membership function. This is represented in FIGS. 8E and 9E that depict the superposition of the scaled control output membership functions of FIGS. 8A through 8D and FIGS. 9A through 9D, respectively. The resulting composite output function for either of the selected goals is the sum of the selected scaled individual control output functions. With reference to FIG. 8E, this composite function includes the area under the dashed line 59A plus the sides 57A' and 51A' of the functions 57A and 51A, respectively. Similarly, the composite function shown in FIG. 9E includes the area under the dashed line 59B plus the sides 58B' and 54B' of the functions 58B and 54B, respectively. The defuzzification unit 35 calculates the centroid for either of the composite functions of FIGS. 8E or 9E to produce a resulting ΔC signal that is the finite signal for controlling the torpedo 10 in FIG. 1.

Figure 10:
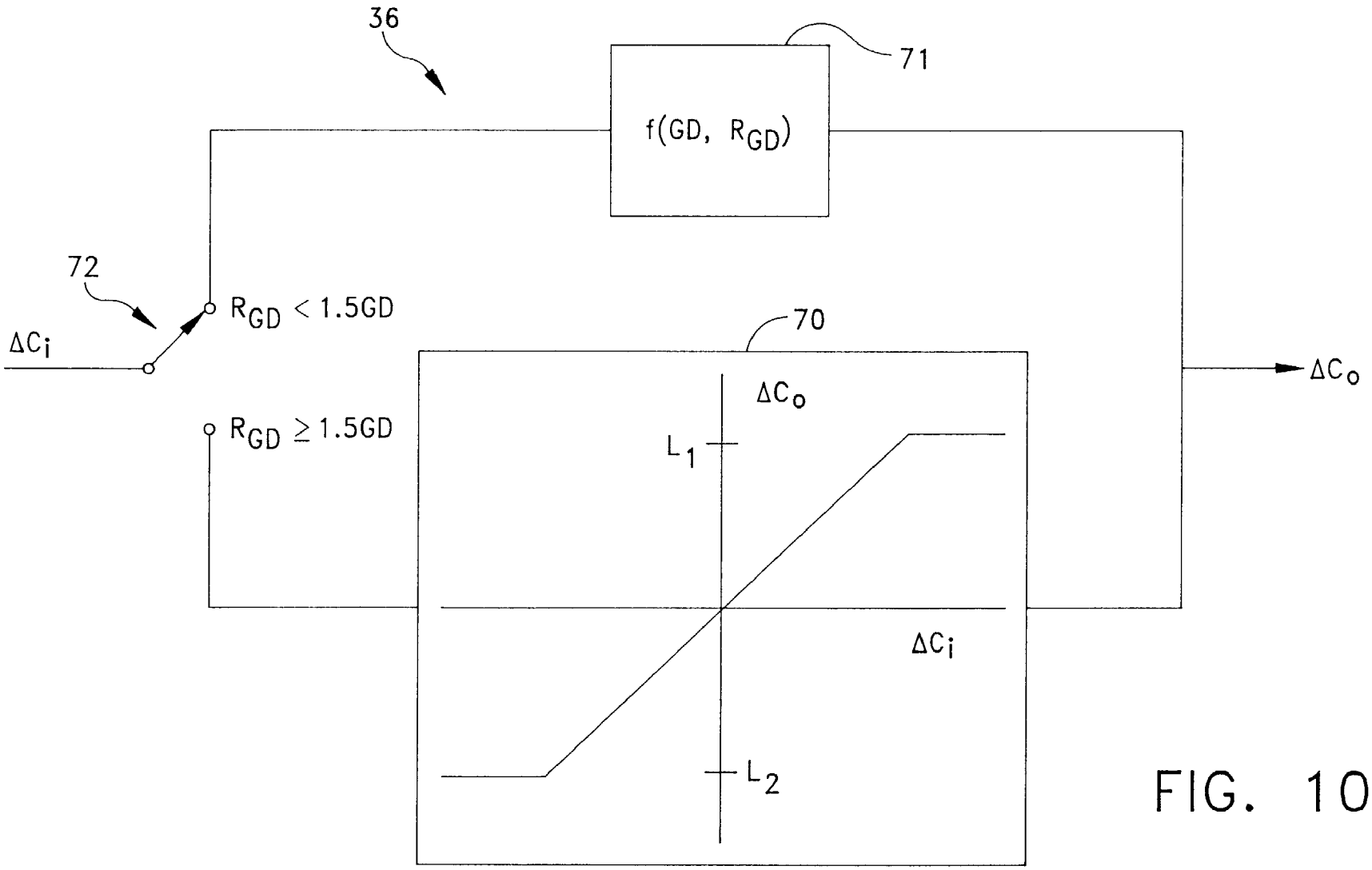
FIG. 10 is a block diagram of a command conditioning unit shown in FIG. 3.

In accordance with a further aspect of this invention, the command conditioning unit 36 modifies the output from the defuzzification unit 35 as depicted in Step 65 of FIG. 4B dependent upon the position of the guidance point 15 of the torpedo 10 relative to the target 12 as shown in FIG. 1. For example, as shown in FIG. 10, the command conditioning unit 36 includes a command limit unit 70 and a gain control unit 71. A switch 72 directs the output of the defuzzification unit 35 in response to the range $R_{GD}$ from the guidance point 15 to the target 12 as a function of the distance GD from the center of gravity or turning point of the torpedo to the guidance point 15. In this specific embodiment, the switch sends commands to the limit circuit 70 when $$R_{GD} \geq 1.5GD \tag{56}$$

and to gain control unit 71 when $$R_{GD} < 1.5GD \tag{57}$$

so the units 70 and 71 operate on a mutually exclusive basis.

The limit circuit 70 operates to assure that the torpedo 10 is not moved into a position whereby it has a searching velocity vector component directed back to the launcher 11. Specifically, the command limit unit 70 interrogates each control command $\Delta C_i$ from the defuzzification unit 35 routed to it through the switch to determine if this command will cause the torpedo 10 to exceed any limits that are governed by a particular circumstance. FIG. 10 graphically represents one set of limits "$L_1$" and "$L_2$". In terms of the specifically disclosed embodiment described above, these limits can be defined mathematically, assuming there is no initial vehicle velocity component toward the launcher, as follows:

$$L_1 = B_v + 90° - (C_{vm})_{k-1} \tag{54}$$

and $$L_2 = B_v - 90° - (C_{vm})_{k-1} \tag{55}$$

where $(C_{vm})_{k-1}$ is the vehicle course from the last update cycle.

If the limit is defined as shown in FIG. 10 and is exceeded, only that portion of the command that will produce a torpedo trajectory perpendicular to the torpedo bearing line between the launcher 11 and torpedo 10 in FIG. 1 will be utilized. In the specific application of a torpedo launched from a submarine, these limits ensure that the trajectory of the torpedo from the addition of various system commands does not produce a velocity component toward the launcher 11 in its then current position so long as the torpedo 10 is distanced from the target contact 12 by a distance greater than 1.5 GD.

As the torpedo 10 approaches the target contact 12 and $R_{GD}$<1.5 GD, the gain control unit 71 in FIG. 10 provides command conditioning by modifying the command as a function of the vehicle guidance distance (GD) and the range ($R_{GD}$) from the guidance point 15 of the torpedo 10 to the target. For example, a modification could be provided according to:

$$K = f(GD, R_{GD}) = K_0 \left( \frac{R_{GD}}{GD} \right) \left( \frac{R_{GD}}{GD} + 1 \right) \tag{56}$$

where $K_0$ is an arbitrary gain constant.

Stated differently, in accordance with this invention, the velocity constraint prevents any velocity component toward the launching vehicle so long as the torpedo 10 is at least 1.5 times the distance from the center point 14 to the guidance point 15 of the torpedo. Within that range, however, the constraint is terminated and the gain adjustment becomes the conditioning element. Consequently the constraint and gain adjustment command conditioning units operate in a mutually exclusive fashion. Moreover, the decision is determined by the location of the torpedo relative to the target, rather than on which of the competing rules are in force.

After the control system 22 generates its command signal subject to the command conditioning unit 36, the communications link 23 transfers the command signal over the communications channel 24 to the communications link 25 in step 66 of FIG. 4B. The guidance system 26 responds to any command requiring a course alteration by changing the path of the torpedo 10.

Figure 11A:
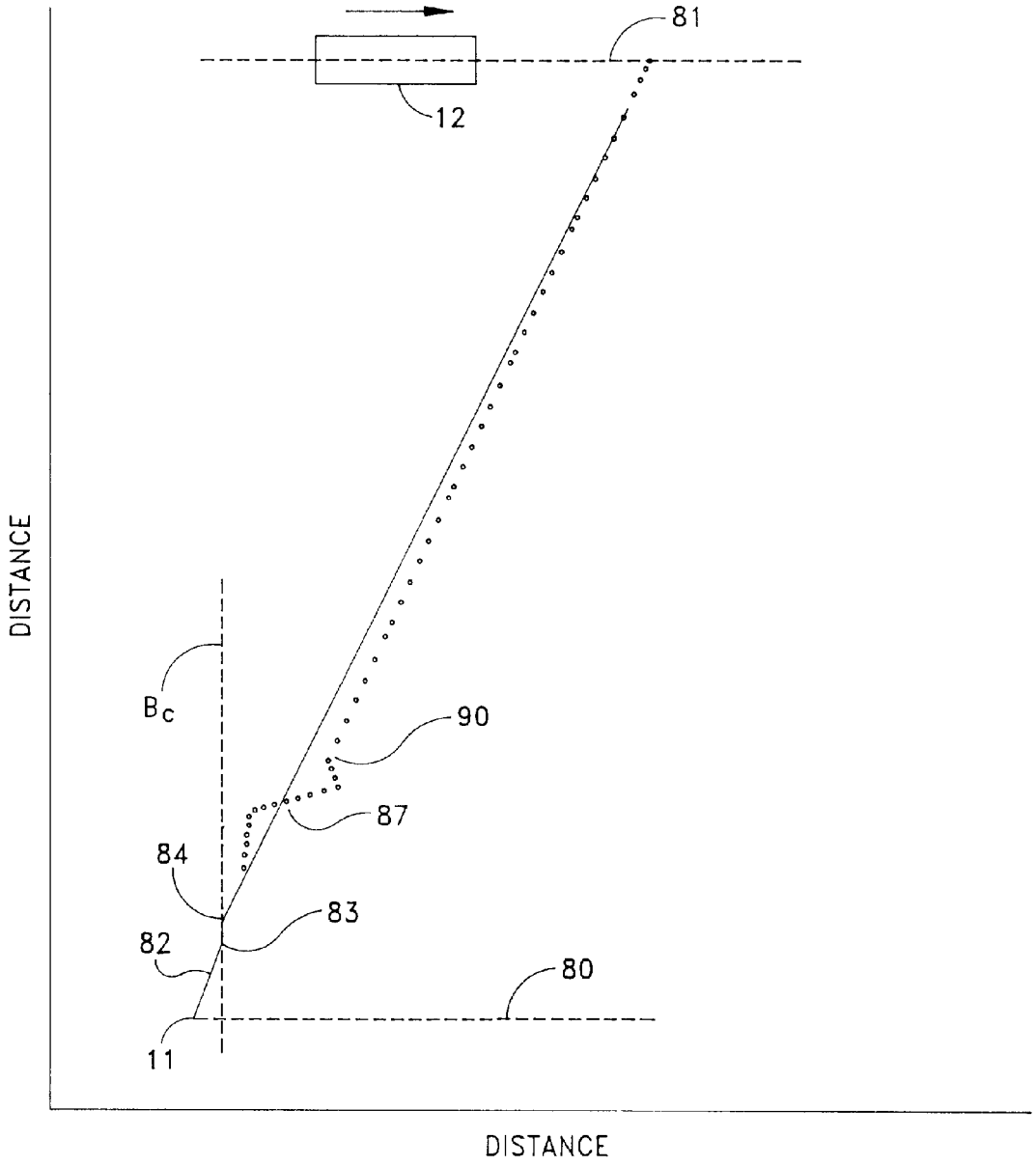
FIGS. 11A, 11B and 11C depict the trajectory of a steerable object for a non-maneuvering target and related signals.

FIG. 11A depicts a sample trajectory for a torpedo when a launcher 11 and target 12 move along parallel courses 80 and 81 respectively at the same speed. Initially the launcher 11 starts the torpedo along a path 82 for a predetermined time, as known. When that time expires at point 83, the control system of FIG. 3 takes control. In this example, at point 83 the $e_s$ signal is negative and indicates that the torpedo 10 is in the forbidden zone. Since the bearing to the torpedo, $B_v$, minus the bearing to the contact, $B_c$, is negative, the multi-goal rule based unit 34 uses the matrix of FIG. 7B for the primary goal. Negative course commands are issued moving the torpedo 10 away from the bearing line until it exits the forbidden zone at point 84 at the time of the positive-going zero crossing of the $e_s$ signal.

Beginning at point 84 the transition of the $e_s$ signal to a positive value enables control to transfer to the matrix of FIG. 7C for the secondary goal (i.e., guidance according to the target intercept method). Consequently, according to the matrix of FIG. 7C the multi-goal rule based unit 34 selects control output membership functions to place the guidance point 15 of the torpedo 10 on a target intercept trajectory.

At 87 the torpedo crosses back into the forbidden zone, so the $e_s$ signal changes to a negative value. This transition causes the hierarchical fuzzy control system 22 to operate according to the primary goal to move the torpedo out of the forbidden zone.

Figure 11B:
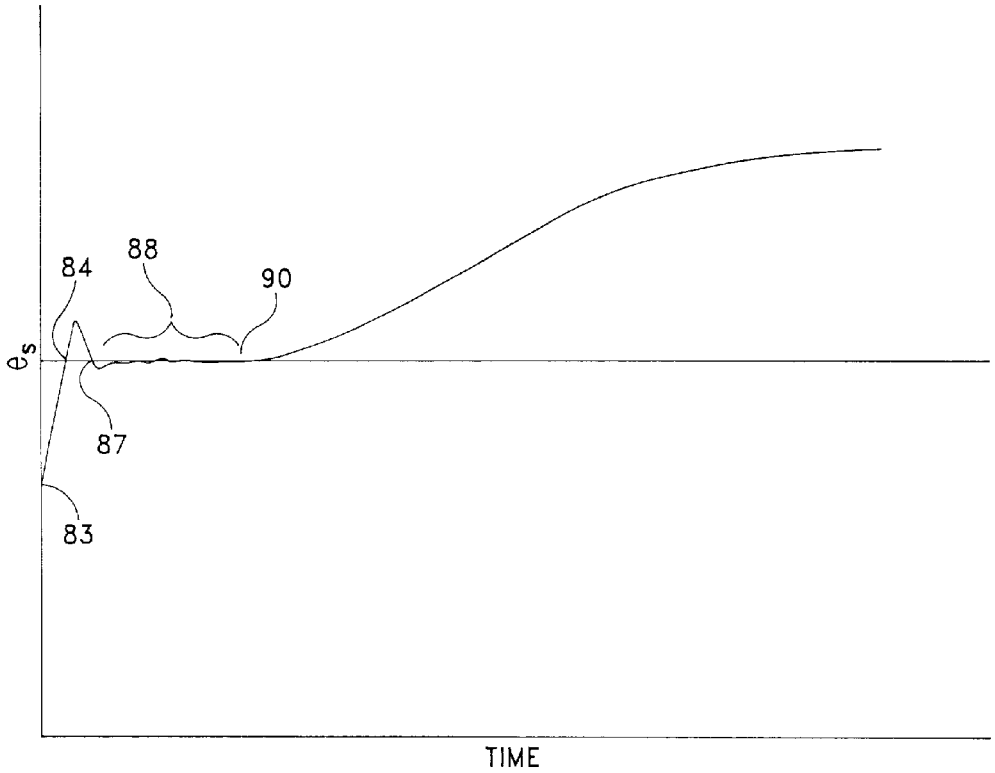
Figure 11C:
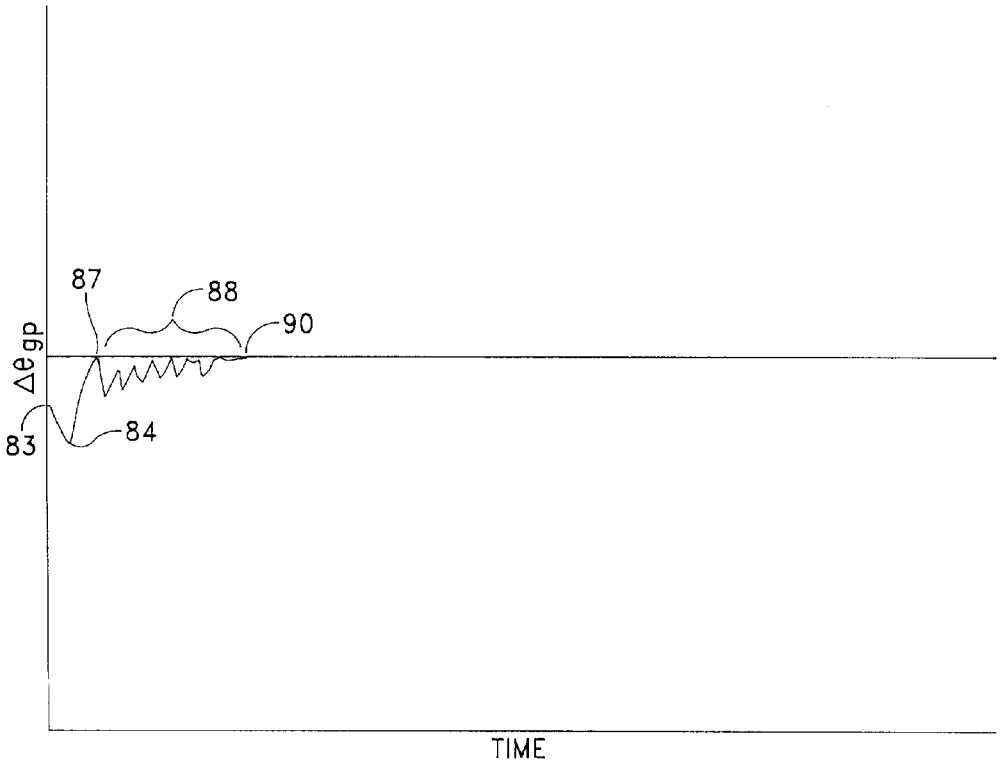

As shown in FIG. 11B, the hierarchical fuzzy control system 22 oscillates between the primary goal and secondary goal over an interval 88 until the motion of the contact bearing line, the size of the guidance distance, the orientation of the torpedo 10 and the decreasing boundary separation angle with increasing vehicle range result in a geometry that allows the vehicle to maintain a course for the guidance point intercept without reentering the forbidden zone for the remainder of the run. This operation begins at point 90 in FIGS. 11A through 11C.

Figure 12A:
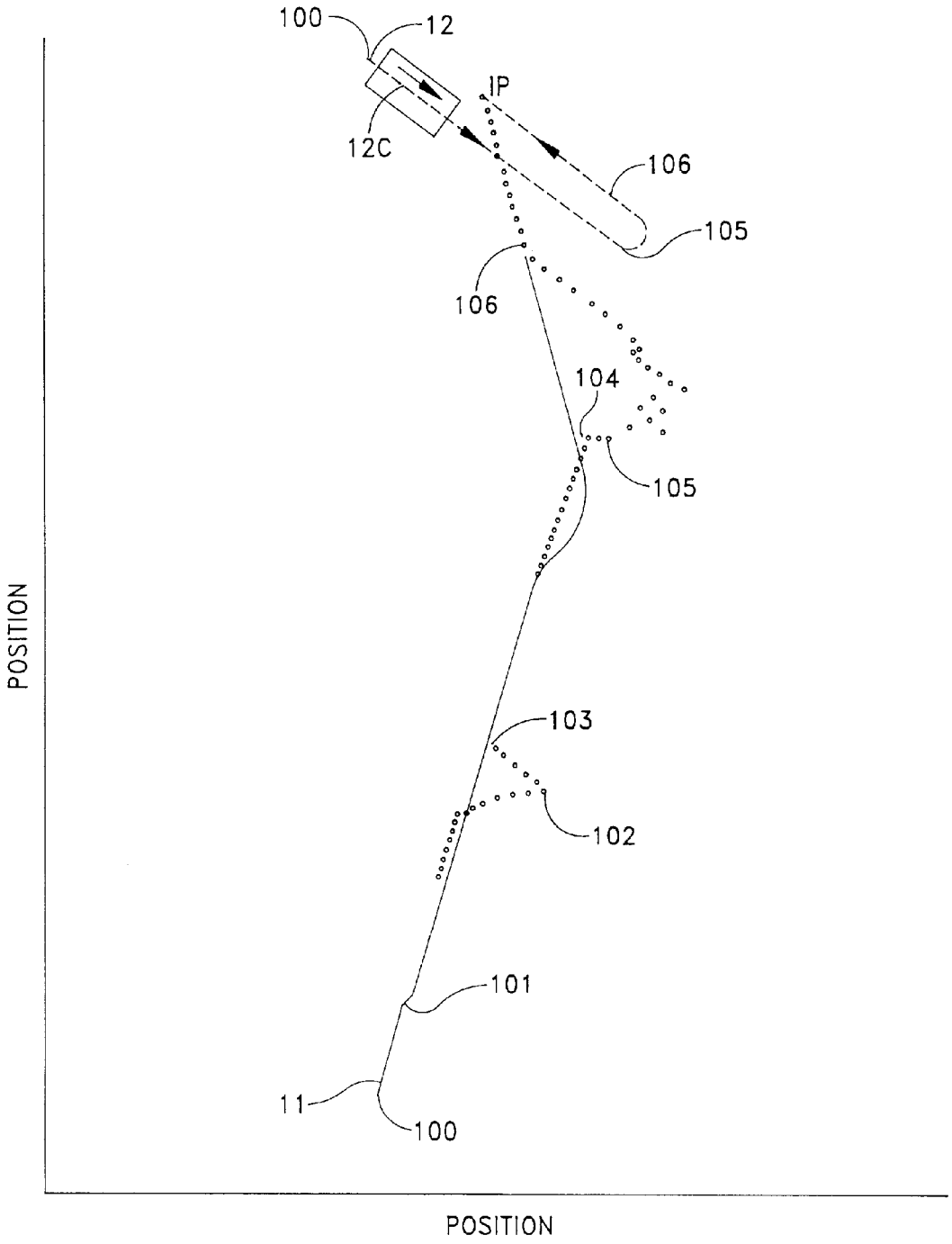
FIGS. 12A, 12B and 12C depict the trajectory of a steerable object for a maneuvering target and related signals.
Figure 12B:
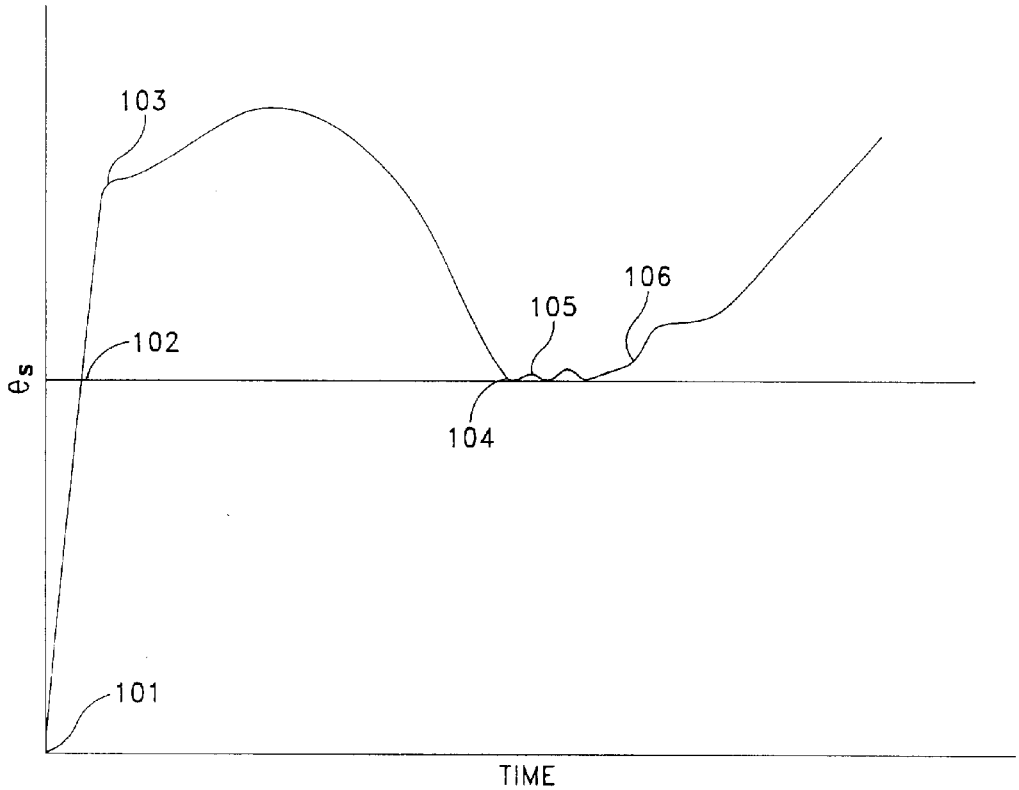
Figure 12C:
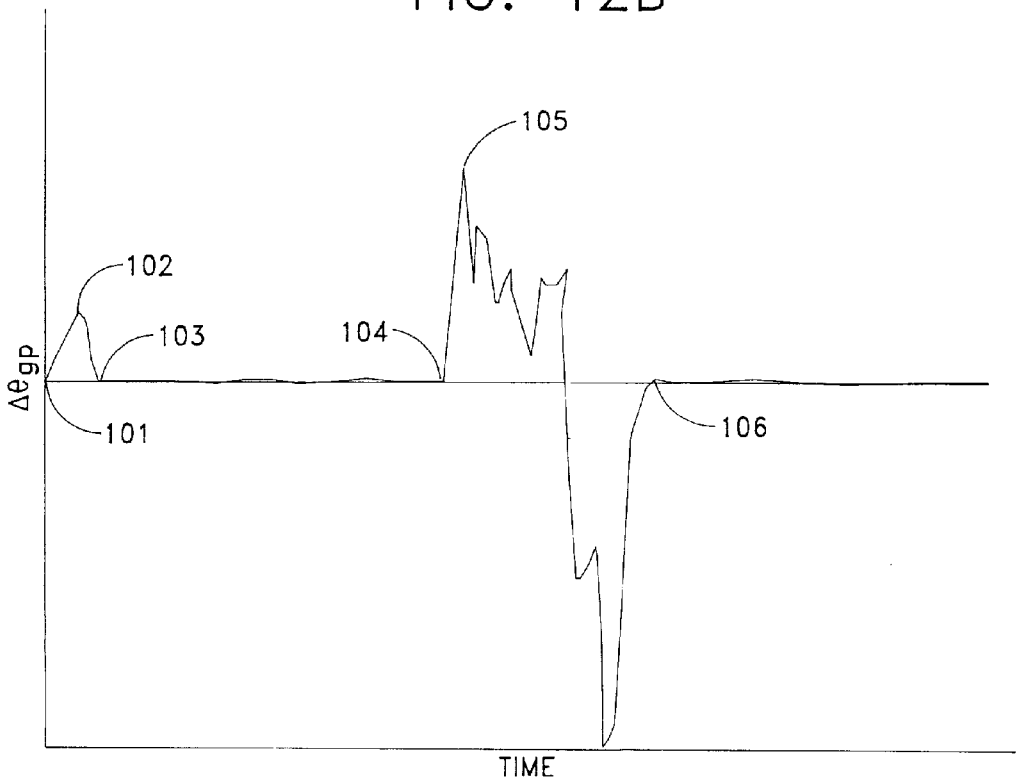

FIGS. 12A, 12B and 12C depict the trajectory of a target 12 and torpedo and the excursions of the $e_s$ and $\Delta e_{gp}$ signals in a situation in which the target takes evasive action. In this case reference number 100 indicates the position of the launching vehicle 11, that is assumed to be stationary, and the target 12 at the time the torpedo is launched along a path to a point 101 when the control system in FIG. 3 becomes active. When control over the torpedo begins, it is in the forbidden zone as indicated by the negative excursion of the $e_s$ signal. In this particular configuration the $(B_v-B_c)$ value is greater than 0. The primary control is selected and positive commands are issued. The resulting commands steer the torpedo outside the zone at point 102 where the value of the $e_s$ signal becomes positive.

With this transition, the control system in FIG. 3 shifts from primary to secondary goal control and begins to impose target intercept guidance parameters on the torpedo. During the interval from point 103 to point 104 the torpedo remains outside the forbidden zone and under secondary control. At point 104, the $e_s$ signal becomes negative indicating that the torpedo is within the forbidden zone and control reverts back to the primary mode. At point 105 the contact maneuvers. The control system in FIG. 3 oscillates between the primary and secondary goals over the interval from point 105 to point 106 when the intercept angle rate of change signal, $\Delta e_{gp}$, goes to zero placing the guidance point 15 on an updated intercept trajectory with the maneuvered contact. As shown in FIG. 12B after point 106, the $e_s$ signal continues to increase in a positive direction and target intercept or secondary control continues with the torpedo guidance point obtaining an intercept with target at an intercept point IP.

If the maneuvering shown in FIG. 12A is considered for a control system that does not include competing goals, but relies merely upon the target intercept guidance system, the oscillating portions between points 104 and 106 do not appear. In fact the $e_s$ signal smoothly varies throughout the trajectory. Moreover the guidance point trajectory for entire contact maneuver remains smooth. However, it is the activity between points 104 and 106 in FIGS. 12A through 12C that assures the positioning of the torpedo outside the zone where it cannot impair the signals being received from the target by the launching vehicle. The interval between reference points 104 and 106 in FIG. 12B, for example, represents a significant time interval during which degradation could cause the control system to fail to recognize the maneuvers of the target.

Thus in accordance with this invention, a control system 22 as shown in FIG. 3 combines a contact bearing, a forbidden zone angular separation and a torpedo bearing and a target bearing measured from a torpedo guidance point and torpedo course to form a plurality of error functions and derivatives thereof. The hierarchical structure of the control system with its primary and secondary goals enables the control system to mediate between two competing goals, namely: maintaining the torpedo outside a predetermined zone along the bearing from the launching vehicle and the target and maintaining the position of the torpedo along a target intercept trajectory.

A control system constructed in accordance with this invention emulates operations that reflect heuristic considerations through the utilization of a rule based expert system that includes a knowledge base that reflects the thinking process of a human. Moreover, the control system has the capability of mediating between two competing goals and automatically generating and issuing control commands.

More specifically, various signals are sampled on a regular iterative basis, so data from two successive sets of signals also provides the rate of change of any angle these signals represent. The fuzzification unit 33 uses corresponding sensed variable membership functions to encode the inputs obtained during one iteration into one or more sensed linguistic variables based on a hierarchial structure by which a primary goal is met in one set of operating conditions and a secondary goal is met in other operating conditions. The multi-goal rule based unit 34 converts these selected sensed linguistic variables into one or more control output linguistic variables. The control system selects control output membership functions of a control output membership function set that then can be combined by diverse procedures to obtain a control signal. Command conditioning prevents the control unit 22 from directing the objects such as a torpedo in an inappropriate direction and, in certain operating conditions, provides a gain or other modification to the command signal necessary to obtain good control with different tactical parameters.

This invention has been described in terms of block diagrams, processes and graphical analysis that will enable anyone of ordinary skill in control systems art to construct a specific embodiment of such a control system. It will be apparent that many modifications can be made to the disclosed apparatus without departing from the invention. Therefore, it is the intent of the appended claims to cover all such variations and modifications as come within the true spirit and scope of this invention.

What is claimed is:

1. In a hierarchial control system for guiding a steerable object from a launching vehicle toward a target in response to multiple goal control rules based upon signals from sensing means corresponding to bearings from the launching vehicle to the steerable object and to the target and from the steerable object to the target wherein said steerable object is characterized by a center point and by a guidance point externally of the steerable object and leading the steerable object as it moves toward the target, said hierarchial control system comprising:

first error means for generating first sensed variable signals in response to the signals from said sensing means indicating the location of the steerable object with respect to a zone about a line between the launching vehicle and the target;

second error means for generating second sensed variable signals in response to the signals from said sensing means indicating whether the bearing from the guidance point to the target is varying with time;

sensed variable means for converting the first and second sensed variable signals into corresponding first and second sensed linguistic variables using corresponding first and second sensed variable membership functions;

control output means for producing a command signal for guiding the steerable object from the launching vehicle toward the target in response to the selection of a control output membership function; and multi-goal rule based means interposed between said sensed variable means and said control output means for selecting said control output membership function in accordance with one of the competing multiple output control rules selected by said multi-goal rule based means in response to the first sensed variable membership functions.

2. A hierarchial control system as recited in claim 1 wherein said first error means includes:

means for determining an angular difference between the bearings from the launching vehicle to the target and to the steerable object and an angular separation about the sensed bearing from the launching vehicle to the target; and means for determining the rate of change of the angular difference and wherein said first sensed linguistic variables and said first membership function sets correspond to the angular difference and the rate of change of the angular difference.

3. A hierarchial control system as recited in claim 2 wherein said sensing means produces a bearing from the guidance point of the steerable object to the target and a course of the steerable object, said second error means selecting said second sensed linguistic variables using corresponding membership functions based upon the difference between the bearing from the guidance point to the target and the course of the steerable object and based upon the rate of change of the difference between the bearing from the guidance point to the target and the course.

4. A hierarchial control system as recited in claim 3 wherein said angular difference determining means generates an angular error signal corresponding to the difference between the bearings from the launching vehicle to the steerable object and from the launching vehicle to the target and an angular separation about the bearing from the launching vehicle to the target to determine whether the steerable object is located within the zone and a rate of change error signal corresponding to the rate of change of bearing signal differences.

5. A hierarchial control system as recited in claim 4 wherein a zone defining means defines the zone as a function of range from the launching vehicle along the bearing to the target object.

6. A hierarchial control system as recited in claim 5 additionally comprising command signal conditioning means for modifying the command signal from said control output means.

7. A hierarchial control system as recited in claim 6 wherein said command conditioning means includes gain adjustment means for adjusting the gain of the command signal in response to the range between the guidance point and the target.

8. A hierarchial control system as recited in claim 6 wherein said command conditioning means includes constraint means for limiting the magnitude of the command signal.

9. A hierarchial control system as recited in claim 6 wherein said command conditioning means includes:

gain adjustment means for adjusting the gain of the command signal in response to the range between the guidance point and the target; constraint means for limiting the magnitude of the command signal; and selection means responsive to signals indicating the range between the guidance point and the target for selecting one of said gain adjustment means and said constraint means for conditioning the command signal.

10. A hierarchial control system as recited in claim 6 wherein said command conditioning means includes:

gain adjustment means for adjusting the gain of the command signal in response to the range between the guidance point and the target;

constraint means for limiting the magnitude of the command signal; and selection means responsive to signals indicating the range between the guidance point and the target for selecting said constraint means when the range between said guidance point and the target exceeds a predetermined multiple of the distance between the center and the guidance point of the steerable object and selects said gain adjustment means when the range is less than the predetermined multiple.

11. A hierarchial control system as recited in claim 6 wherein said command conditioning means includes:

gain adjustment means for adjusting the gain of the command signal in response to the range between the guidance point and the target;

constraint means for limiting the magnitude of the command signal; and selection means responsive to signals indicating the range between the guidance point and the target for selecting said constraint means when the range between said guidance point and the target exceeds a predetermined value of about 1.5 times the distance between the center and the guidance point of the steerable object and selects said gain adjustment means when the range is less than a predetermined multiple.

12. A hierarchial control system as recited in claim 1 additionally comprising command signal conditioning means for modifying the command signal from said control output means.

13. A hierarchial control system as recited in claim 12 wherein said command conditioning means includes gain adjustment means for adjusting the gain of the command signal in response to the range between the guidance point and the target.

14. A hierarchial control system as recited in claim 12 wherein said command conditioning means includes constraint means for limiting the magnitude of the command signal.

15. A hierarchial control system as recited in claim 12 wherein said command conditioning means includes:

gain adjustment means for adjusting the gain of the command signal in response to the range between the guidance point and the target;

constraint means for limiting the magnitude range of the command signal; and selection means responsive to signals indicating the range between the guidance point and the target for selecting one of said gain adjustment means and said constraint means for conditioning the command signal.

16. A hierarchial control system as recited in claim 12 wherein said command conditioning means includes:

gain adjustment means for adjusting the gain of the command signal in response to the range between the guidance point and the target;

constraint means for limiting the magnitude of the command signal; and selection means responsive to signals indicating the range between the guidance point and the target for selecting said constraint means when the range between said guidance point and the target exceeds a predetermined multiple of the distance between the center and the guidance point of the steerable object and selects said gain adjustment means when the range is less than the predetermined multiple.

17. A hierarchial control system as recited in claim 12 wherein said command conditioning means includes:

gain adjustment means for adjusting the gain of the command signal in response to the range between the guidance point and the target;

constraint means for limiting the magnitude of the command signal; and selection means responsive to signals indicating the range between the guidance point and the target for selecting said constraint means when the range between said guidance point and the target exceeds a predetermined value of about 1.5 times the distance between the center and the guidance point of the steerable object and selects said gain adjustment means when the range is less than a predetermined multiple.

18. An iterative method for guiding a steerable object from a launching vehicle to a target in response to any of competing sets of multiple goal control rules based upon signals from sensing means corresponding to bearings from the launching vehicle to the steerable object and to the target and from the steerable object to the target wherein the steerable object is characterized by a center point and by a guidance point externally of the steerable object and leading the steerable object as it travels toward the target wherein each said iteration comprises the steps of:

generating first sensed variable signals in response to the signals from the sensing means indicating the location of the steerable object with respect to a zone about a line between the launching vehicle and the target;

generating second sensed variable signals in response to the signals from the sensing means indicating whether the bearing from the guidance point of the steerable object to the target is varying with time;

retrieving first and second sensed linguistic variables in response to the first and second sensed variable signals, respectively;

selecting at least one control output linguistic variable from a predetermined set of control output linguistic variables in response to the selected first or second sensed linguistic variables from the first set when the first sensed variable signals indicate that the steerable object is proximate or inside the predetermined zone and in response to the second set when the sensed variable signals indicate that the steerable object is outside the predetermined zone;

generating a command signal for controlling the steerable object in response to a control output linguistic variables selection; and transferring the command signal to the steerable object.

19. A method as recited in claim 18 wherein the step of generating the first sensed variable signals includes the steps of:

determining an angular difference between the bearings from the launching vehicle to the target and to the steerable object and an angular separation about the sensed bearing from the launching vehicle to the target; and determining the rate of change of the angular difference and wherein the first sensed linguistic variables and said first membership function sets correspond to the angular difference and the rate of change of the angular difference.

20. A method as recited in claim 19 wherein the step of generating the second sensed variable signals includes determining a bearing from the guidance point to the target and selecting corresponding second sensed linguistic variables based upon the difference between the bearing from the guidance point to the target and the course of the steerable object and based upon the rate of change of the difference between the bearing from the guidance point to the target and the course.

21. A method as recited in claim 20 wherein said step of determining angular difference includes generating a angular error signal corresponding to the difference between the bearings from the launching vehicle to the steerable object and to the target and an angular separation about the bearing from the launching vehicle to the target thereby to indicate whether the steerable object is located within a zone about the bearing from the launching vehicle to the target and a rate of change error signal corresponding to the rate of change of the bearing signal differences.

22. A method as recited in claim 21 further comprising a step of defining the zone includes defining the zone as a function of range from the launching vehicle along the bearing to the target object.

23. A method as recited in claim 22 wherein the step of generating the command signal includes the step of modifying the command signal from the control output linguistic variable selection.

24. A method as recited in claim 23 wherein said step of modifying the command signal includes the step of adjusting the gain of the command signal in response to the range between the guidance point and the target.

25. A method as recited in claim 23 wherein said step of modifying the command signal includes the step of constraining the magnitude of the command signal.

26. A method as recited in claim 23 wherein said step of modifying the command signal includes the step of modifying the command signal by:

selecting, under first conditions, a step of adjusting the gain of the command signal in response to the range between the guidance point and the target; and selecting, under other conditions, a step of constraining the magnitude of the command signal.

27. A method as recited in claim 23 wherein said step of modifying the command signal includes the step of modifying the command signal by:

selecting, under first conditions when the sensed variable signals indicate that the range between the guidance point and the target is less than a predetermined multiple of the distance between the center and the guidance point of the steerable object, a step of adjusting the gain of the command signal in response to the range between the guidance point and the target; and selecting, under other conditions, a step of constraining the magnitude of the command signal.

28. A method as recited in claim 23 wherein said step of modifying the command signal includes the step of modifying the command signal by:

selecting, under first conditions when the sensed variable signals indicate that the range between the guidance point and the target is less than 1.5 times the distance between the center and the guidance point of the steerable object, a step of adjusting the gain of the command signal in response to the range between the guidance point and the target; and selecting, under other conditions, a step of constraining the magnitude of the command signal.

29. A method as recited in claim 18 wherein the step of generating the command signal includes the step of modifying the command signal from the control output linguistic variable selection.

30. A method as recited in claim 18 wherein said step of modifying the command signal includes the step of adjusting the gain of the command signal in response to the range between the guidance point and the target.

31. A method as recited in claim 29 wherein said step of modifying the command signal includes the step of constraining the magnitude of the command signal.

32. A method as recited in claim 29 wherein said step of modifying the command signal includes the step of modifying the command signal by:

selecting, under first conditions, a step of adjusting the gain of the command signal in response to the range between the guidance point and the target; and selecting, under other conditions, a step of constraining the magnitude of the command signal.

33. A method as recited in claim 29 wherein said step of modifying the command signal includes the step of modifying the command signal by:

selecting, under first conditions when the sensed variable signals indicate that the range between the guidance point and the target is less than a predetermined multiple of the distance between the center and the guidance point of the steerable object, a step of adjusting the gain of the command signal in response to the range between the guidance point and the target; and selecting, under other conditions, a step of constraining the magnitude of the command signal.

34. A method as recited in claim 29 wherein said step of modifying the command signal includes the step of modifying the command signal by:

selecting, under first conditions when the sensed variable signals indicate that the range between the guidance point and the target is less than 1.5 times the distance between the center and guidance points of the steerable object, a step of adjusting the gain of the command signal in response to the range between the guidance point and the target; and selecting, under other conditions, a step of constraining the magnitude of the command signal.

* * * * *